US007977885B2

(12) United States Patent
Bewlay et al.

(10) Patent No.: US 7,977,885 B2
(45) **Date of Patent: *Jul. 12, 2011**

(54) HIGH INTENSITY DISCHARGE LAMP HAVING COMPLIANT SEAL

(75) Inventors: Bernard Bewlay, Schenectady, NY (US); Bruce Knudsen, Amsterdam, NY (US); Mohamed Rahmane, Clifton Park, NY (US); James Vartuli, Rexford, NY (US); James Brewer, Scotia, NY (US)

(73) Assignee: General Electric Company, Niskayuna, NY (US)

( * ) Notice: Subject to any disclaimer, the term of this patent is extended or adjusted under 35 U.S.C. 154(b) by 464 days.

This patent is subject to a terminal disclaimer.

(21) Appl. No.: 12/106,105

(22) Filed: Apr. 18, 2008

(65) Prior Publication Data

US 2008/0211410 A1 Sep. 4, 2008

Related U.S. Application Data

(63) Continuation of application No. 11/289,128, filed on Nov. 29, 2005, now Pat. No. 7,378,799.

(51) Int. Cl.
*H01J 61/36* (2006.01)
*H01J 17/18* (2006.01)

(52) U.S. Cl. ..... 313/623; 313/624; 313/625; 313/634; 313/636; 313/318.01

(58) Field of Classification Search ..... 313/318.07, 313/318.09, 623–625, 636
See application file for complete search history.

(56) References Cited

U.S. PATENT DOCUMENTS

| | | | | |
|---|---|---|---|---|
| 3,363,134 | A | 1/1968 | Johnson | |
| 3,385,463 | A | 5/1968 | Lange | |
| 3,659,138 | A | 4/1972 | Johnson et al. | |
| 3,662,455 | A | 5/1972 | Anderson | |
| 3,693,007 | A | 9/1972 | Kerekes | |
| 3,872,341 | A | 3/1975 | Werner et al. | |
| 3,882,344 | A | 5/1975 | Knochel et al. | |
| 3,882,346 | A | 5/1975 | McVey | |
| 3,953,177 | A | 4/1976 | Sedlatschek et al. | |
| 4,103,200 | A | 7/1978 | Bhalla | |
| 4,282,395 | A * | 8/1981 | Hagemann | 174/50.61 |
| 4,291,250 | A | 9/1981 | Bhalla | |
| 4,409,517 | A | 10/1983 | Van Der Sande et al. | |

(Continued)

FOREIGN PATENT DOCUMENTS

EP 0935278 8/1999

(Continued)

OTHER PUBLICATIONS

Tokumatsu Tachiwaki et al., "*Novel Synthesis of $Y_3Al_5O_{12}$ (YAG) Leading to Transparent Ceramics*", Solid State Communications, vol. 119, pp. 603-606, 2001.

(Continued)

*Primary Examiner* — Bumsuk Won
(74) *Attorney, Agent, or Firm* — Fletcher Yoder

(57) ABSTRACT

In certain embodiments, a lamp is provided with an arc envelope including a ceramic, an end member including a material different from the ceramic, and a compliant seal disposed between the end member and the arc envelope. The compliant seal includes a plurality of layers having different thermal expansion characteristics in an order of gradual change between the arc envelope and the end member.

23 Claims, 13 Drawing Sheets

U.S. PATENT DOCUMENTS

| | | | | |
|---|---|---|---|---|
| 4,464,603 | A | 8/1984 | McVey | |
| 4,507,584 | A | 3/1985 | Coaton et al. | |
| 4,545,799 | A | 10/1985 | Rhodes et al. | |
| 4,585,972 | A | 4/1986 | Hing | |
| 4,707,636 | A | 11/1987 | Morris | |
| 4,780,646 | A | 10/1988 | Lange | |
| 4,804,889 | A | 2/1989 | Reid et al. | |
| 5,057,048 | A | 10/1991 | Feuersanger et al. | |
| 5,321,335 | A | 6/1994 | Klug et al. | |
| 5,424,609 | A | 6/1995 | Geven et al. | |
| 5,426,343 | A | 6/1995 | Rhodes et al. | |
| 5,552,670 | A | 9/1996 | Heider et al. | |
| 5,725,827 | A | 3/1998 | Rhodes et al. | |
| 5,783,907 | A | 7/1998 | Suzuki et al. | |
| 5,973,453 | A | 10/1999 | Van Viet et al. | |
| 5,994,839 | A | 11/1999 | Yamamoto et al. | |
| 6,069,456 | A | 5/2000 | Fromm et al. | |
| 6,126,889 | A | 10/2000 | Scott et al. | |
| 6,215,254 | B1 | 4/2001 | Honda et al. | |
| 6,216,889 | B1 | 4/2001 | Chang | |
| 6,265,827 | B1 | 7/2001 | Takahashi et al. | |
| 6,294,871 | B1 | 9/2001 | Scott et al. | |
| 6,300,716 | B1 | 10/2001 | Honda | |
| 6,375,533 | B1 * | 4/2002 | Torikai et al. | 445/26 |
| 6,404,129 | B1 | 6/2002 | Hendriex et al. | |
| 6,495,959 | B1 * | 12/2002 | Ikeuchi et al. | 313/623 |
| 6,528,945 | B2 | 3/2003 | Kelly et al. | |
| 6,583,563 | B1 | 6/2003 | Venkataramani et al. | |
| 6,635,993 | B1 | 10/2003 | Niimi | |
| 6,642,654 | B2 | 11/2003 | Niimi | |
| 6,657,388 | B2 | 12/2003 | Wijenberg et al. | |
| 6,750,612 | B2 | 6/2004 | Takagaki et al. | |
| 6,781,292 | B2 | 8/2004 | Ishida et al. | |
| 6,791,267 | B2 | 9/2004 | Niimi | |
| 6,812,642 | B1 | 11/2004 | Niimi | |
| 6,815,894 | B2 | 11/2004 | Takagaki et al. | |
| 6,873,109 | B2 | 3/2005 | Ishigami et al. | |
| 7,126,281 | B2 | 10/2006 | Grundmann et al. | |
| 7,132,797 | B2 | 11/2006 | Kebbede et al. | |
| 7,215,081 | B2 | 5/2007 | Bewlay et al. | |
| 7,230,383 | B2 | 6/2007 | Tsuda et al. | |
| 7,279,838 | B2 | 10/2007 | Ramaiah et al. | |
| 7,329,979 | B2 | 2/2008 | Bewlay et al. | |
| 7,378,799 | B2 * | 5/2008 | Bewlay et al. | 313/636 |
| 2002/0027421 | A1 | 3/2002 | Kaneko et al. | |
| 2002/0117965 | A1 | 8/2002 | Kotter et al. | |
| 2004/0070343 | A1 * | 4/2004 | Niimi | 313/623 |
| 2004/0119414 | A1 * | 6/2004 | Bewlay et al. | 313/636 |
| 2004/0124776 | A1 | 7/2004 | Iorio et al. | |
| 2004/0135510 | A1 | 7/2004 | Bewlay et al. | |
| 2004/0174121 | A1 | 9/2004 | Tsuda et al. | |
| 2006/0001346 | A1 | 1/2006 | Vartuli et al. | |
| 2006/0008677 | A1 | 1/2006 | Bewlay et al. | |
| 2006/0100088 | A1 | 5/2006 | Loureiro et al. | |
| 2007/0001610 | A1 | 1/2007 | Bewlay et al. | |
| 2007/0001611 | A1 | 1/2007 | Bewlay et al. | |
| 2007/0001612 | A1 | 1/2007 | Bewlay et al. | |

FOREIGN PATENT DOCUMENTS

| | | |
|---|---|---|
| EP | 1150337 | 10/2001 |
| EP | 1158567 | 11/2001 |
| EP | 1172839 | 1/2002 |
| EP | 1172840 | 1/2002 |
| EP | 1220295 | 7/2002 |
| EP | 1253616 | 10/2002 |
| EP | 1296355 | 3/2003 |
| EP | 1351276 | 10/2003 |
| EP | 1363313 | 11/2003 |
| EP | 1434247 | 6/2004 |
| JP | 2004214194 | 7/2004 |
| WO | WO9825294 | 6/1998 |
| WO | WO03058674 | 7/2003 |
| WO | WO2003099741 | 12/2003 |
| WO | WO2004023517 | 3/2004 |
| WO | WO2004049390 | 6/2004 |
| WO | WO2004049391 | 6/2004 |
| WO | WO2004051699 | 6/2004 |
| WO | WO2004051700 | 6/2004 |
| WO | WO2004102614 | 11/2004 |

OTHER PUBLICATIONS

Lei Wen et al., *"Synthesis of Nanocrystalline Yttria Powder and Fabrication of Transparent YAG Ceramics"*, Journal of the European Ceramic Society, vol. 24, pp. 2681-2688, 2003.

D. Hreniak et al., *"Synthesis and Optical Properties of $Nd^3$ +- Doped $Y_3Al_5O_{12}$ Nanoceramics"*, Journal of Alloys and Compounds, vol. 341, pp. 183-186, 2002.

Guanshi Qin et al., *"Upconversion Luminescence of $Er^3$ + in Highly Transparent YAG Ceramics"*, Solid State Communications, vol. 132, pp. 103-106, 2004.

Jianren Lu et al., "*Neodymium Doped Yttrium Aluminum Garnet ($Y_3Al_5O_{12}$) Nanocrystalline Ceramics—A New Generation of Solid State Laser and Optical Materials"*, Journal of Alloys and Compounds, vol. 341, pp. 220-225, 2002.

A.K. Pradhan et al., *"Synthesis of Neodymium-Doped Yttrium Aluminum Garnet (YAG) Nanocrystalline Powders Leading to Transparent Ceramics"*, Materials Research Bulletin, vol. 39, pp. 1291-1298, 2004.

* cited by examiner

HIGH INTENSITY DISCHARGE LAMP HAVING COMPLIANT SEAL

CROSS REFERENCE TO RELATED APPLICATION

This application is a continuation of U.S. patent application Ser. No. 11/289,128, entitled "High Intensity Discharge Lamp Having Compliant Seal," filed Nov. 29, 2005, which is herein incorporated by reference in its entirety.

BACKGROUND

This section is intended to introduce the reader to various aspects of art that may be related to aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

High-intensity discharge (HID) lamps are often formed from a ceramic tubular body or arc tube that is sealed to one or more end structures. The end structures are often sealed to this ceramic tubular body using a single seal glass. Sealing usually involves heating the assembly of the ceramic tubular body, the end structures, and the seal glass to induce melting of the seal glass and reaction with the ceramic arc tube and the end structures to form a strong chemical and physical/mechanical bond. The ceramic tubular body and the end structures are often made of the same material, such as polycrystalline alumina (PCA). Thus, the single seal glass may have physical and mechanical properties matching those of all of the ceramic components, i.e., the ceramic arc tube and the ceramic end structures.

However, certain applications may require the use of different materials for the ceramic arc tube and the end structures. Unfortunately, various stresses may arise from the sealing process, the interface between the joined components, and the materials used for the different components. For example, the materials of the ceramic arc tube, the end structures, and the single seal glass may have different mechanical and physical properties. These properties generally include different coefficients of thermal expansion (CTE), which can lead to residual stresses and sealing cracks. These potential stresses and sealing cracks are particularly problematic for high-pressure lamps and operational conditions involving rapid cycling.

The geometry of the interface between the ceramic arc tube and the end structures also may attribute to the foregoing stresses. For example, the end structures are often shaped as a plug or a pocket, which interfaces both the flat and cylindrical surfaces of the ceramic arc tube. If the components have different coefficients of thermal expansion and elastic properties, then residual stresses arise because of the different strains that prevent relaxation of the materials to stress-free states. For example, in the case of the plug type end structure, if the plug has a lower coefficient of thermal expansion than the ceramic tubular body and seal glass, then compressive stresses arise in the plug region while tensile stresses arise in the ceramic arc tube.

In addition to the ceramic arc tube and end structures, high-intensity discharge lamps also include a variety of internal materials (e.g., gases) and electrode materials to create the desired high-intensity discharge for lighting. The particular internal materials disposed in the high-intensity discharge lamps can affect the sealing characteristics, the light characteristics, and the type of materials that may be workable for the lamp components and the seal glass. For example, certain internal materials, such as halides and metal halides, may be desirable for lighting characteristics, but they are corrosive to some of the ceramic and metallic components that comprise the tubular body and end structure.

Accordingly, a technique is needed to provide a lighting system, such as high-intensity discharge lamp, with improved sealing characteristics.

BRIEF DESCRIPTION

Certain aspects commensurate in scope with the originally claimed invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

In accordance with a first aspect of the present invention, a lamp is provided with an arc envelope including a ceramic, an end member including a material different from the ceramic, and a compliant seal disposed between the end member and the arc envelope. The compliant seal includes a plurality of layers having different thermal expansion characteristics in an order of gradual change between the arc envelope and the end member.

In accordance with a second aspect of the present invention, a system is provided with a lamp including a ceramic arc envelope and a dosing tube coupled to the ceramic arc envelope via a compliant seal, wherein the compliant seal comprises a plurality of layers having different thermal expansion characteristics in an order of gradual change between the ceramic arc envelope and the dosing tube. The dosing tube has a material composition including a cermet, or a metal, or a combination thereof. The lamp also includes an electrode lead extending through the dosing tube to an arc electrode disposed inside the ceramic arc envelope, wherein the dosing tube is compressed and sealed about the electrode lead.

In accordance with a third aspect of the present invention, there is provided a method of operating a lamp. The method includes thermally expanding with different thermal expansion characteristics in a plurality of layers of material in a compliant seal between an arc envelope and an end member, wherein the arc envelope includes a ceramic and the end member includes a material different from the ceramic.

Various refinements of the features noted above exist in relation to the various aspects of the present invention. Further features may also be incorporated in these various aspects as well. These refinements and additional features may exist individually or in any combination. For instance, various features discussed below in relation to one or more of the illustrated embodiments may be incorporated into any of the above-described aspects of the present invention alone or in any combination. Again, the brief summary presented above is intended only to familiarize the reader with certain aspects and contexts of the present invention without limitation to the claimed subject matter.

DRAWINGS

These and other features, aspects, and advantages of the present invention will become better understood when the following detailed description is read with reference to the accompanying drawings in which like characters represent like parts throughout the drawings, wherein:

FIGS. 1 and 2 are cross-sectional side views of exemplary lamp assemblies having a pair of compliant seals disposed between an arc envelope and a pair of dosing tubes, wherein each compliant seal includes a plurality of layers having different thermal expansion characteristics in an order of gradual change between the arc envelope and the respective dosing tube in accordance with certain embodiments of the present technique;

Figure 1:
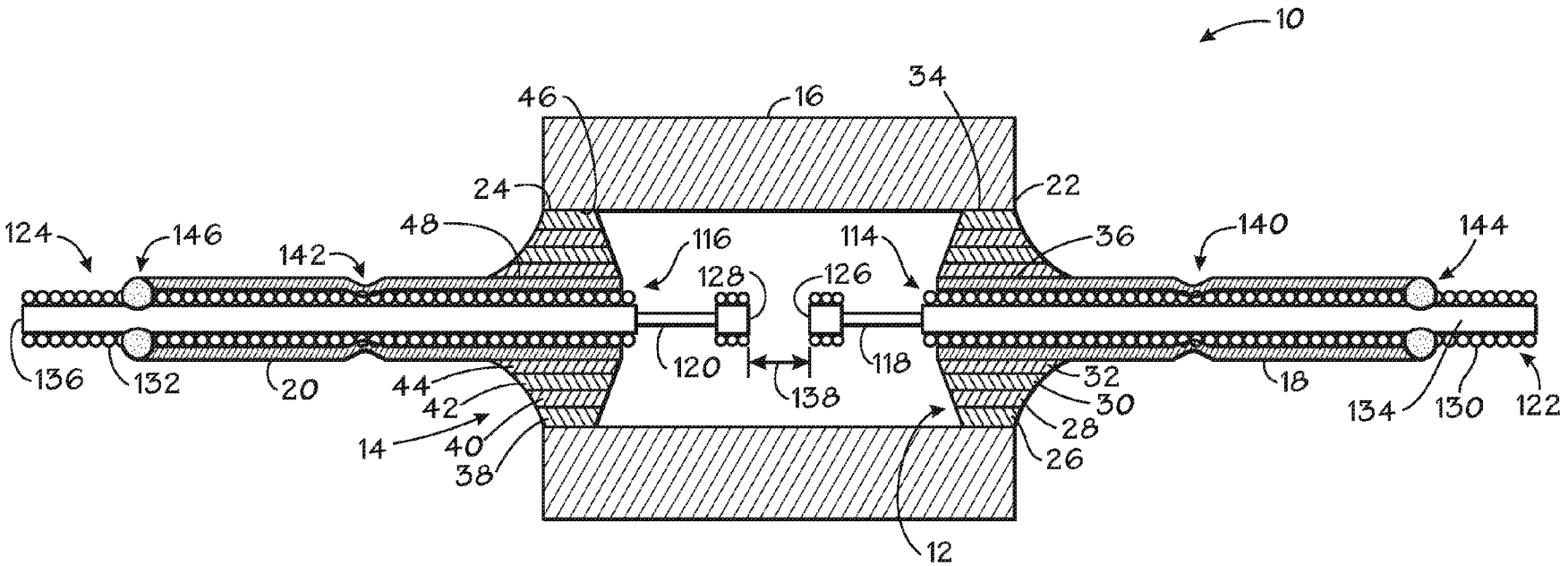
Figure 2:
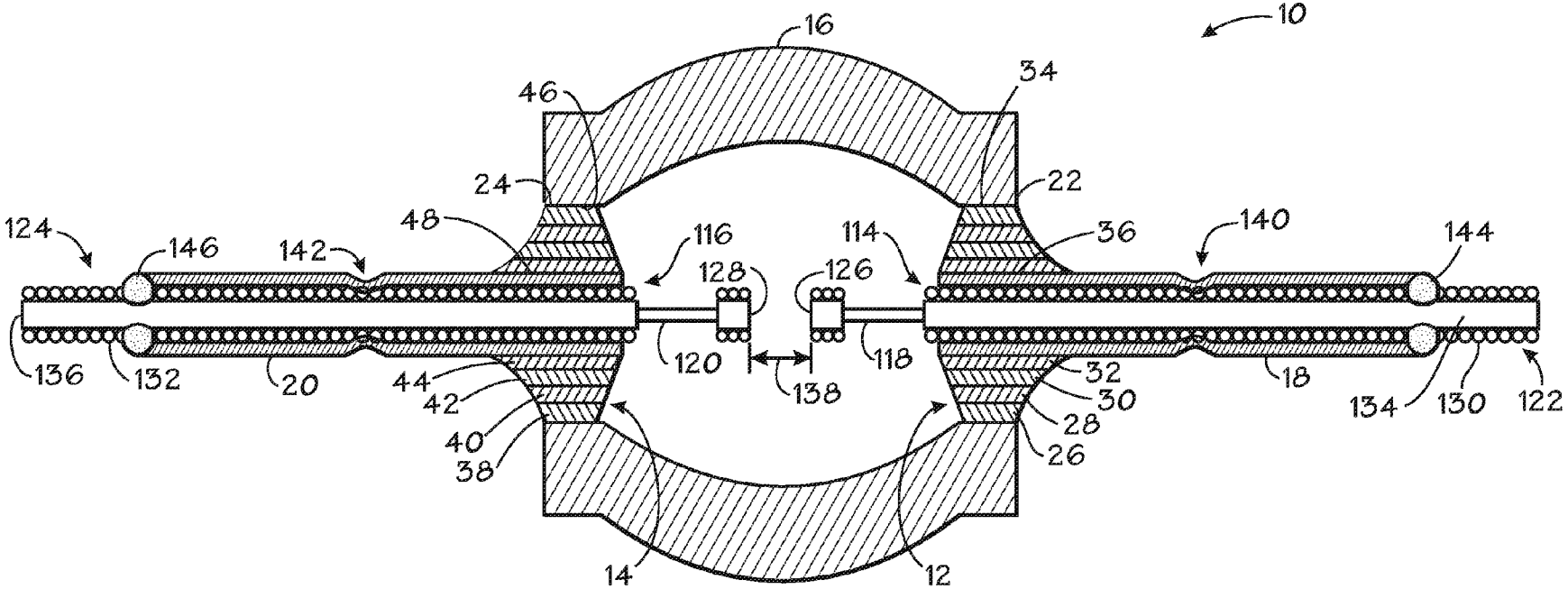
Figure 5:
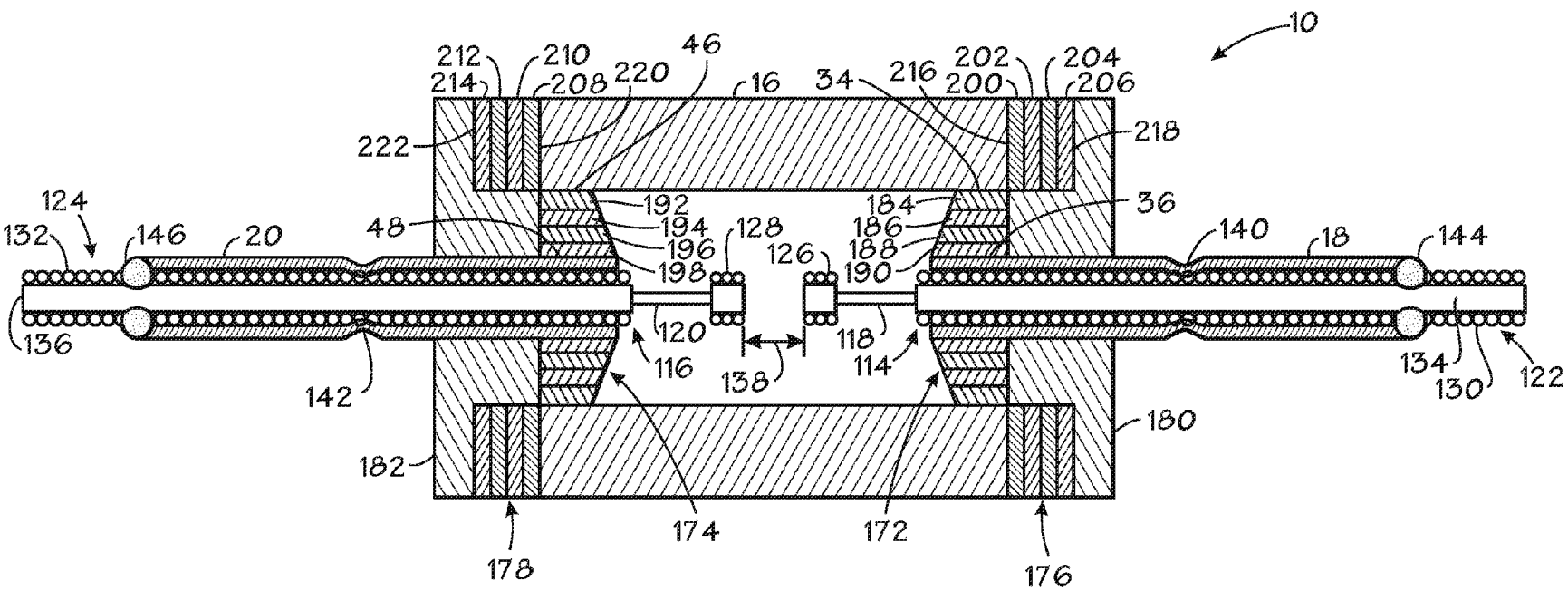
Figure 6:
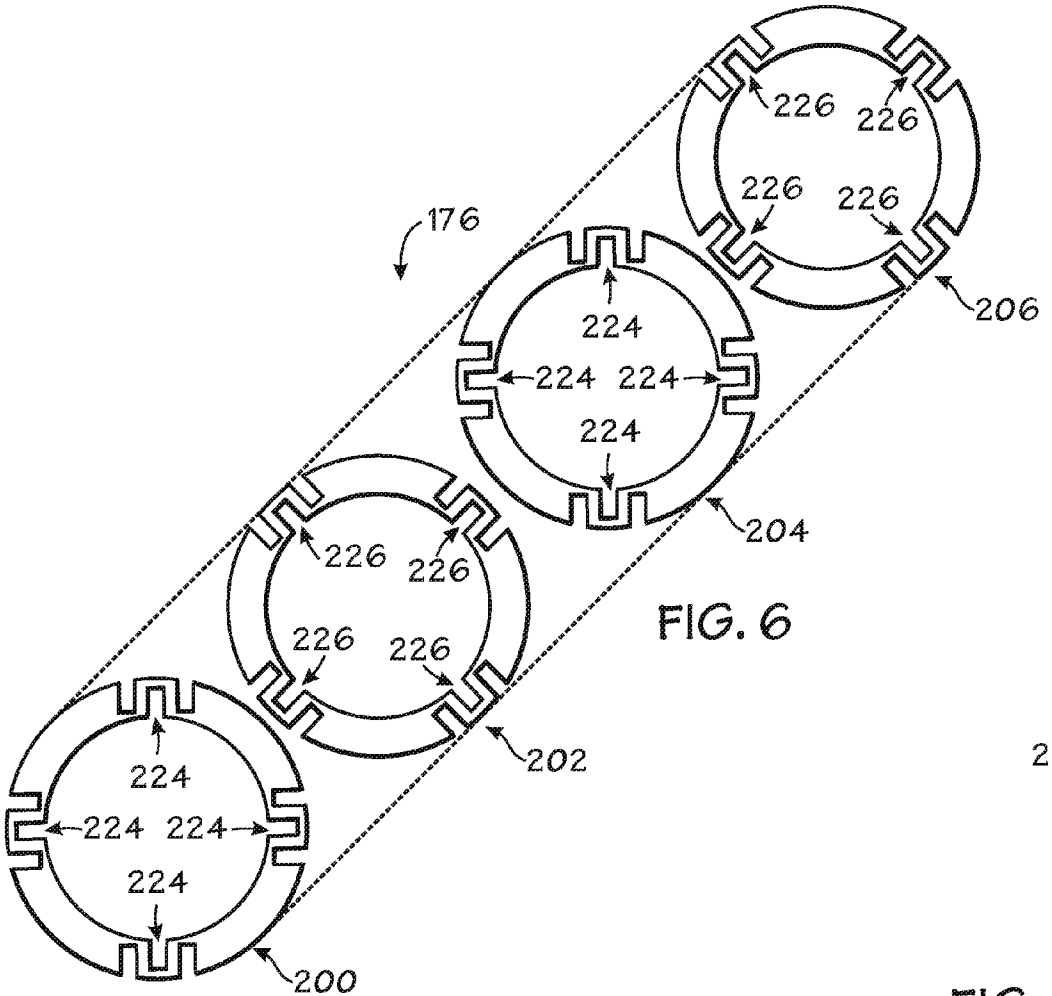
Figure 7:
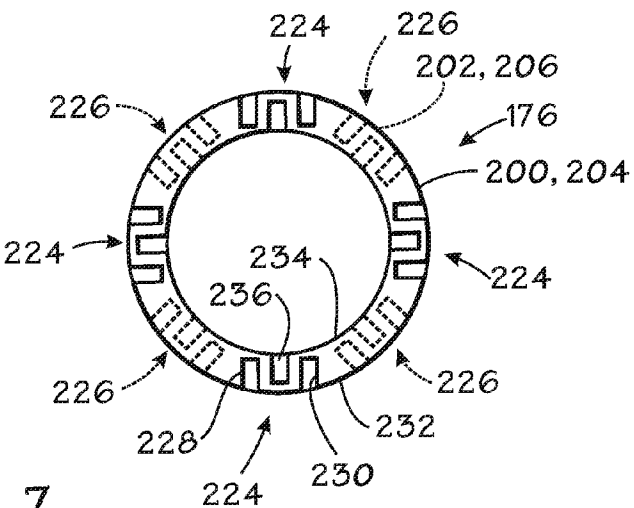
Figure 8:
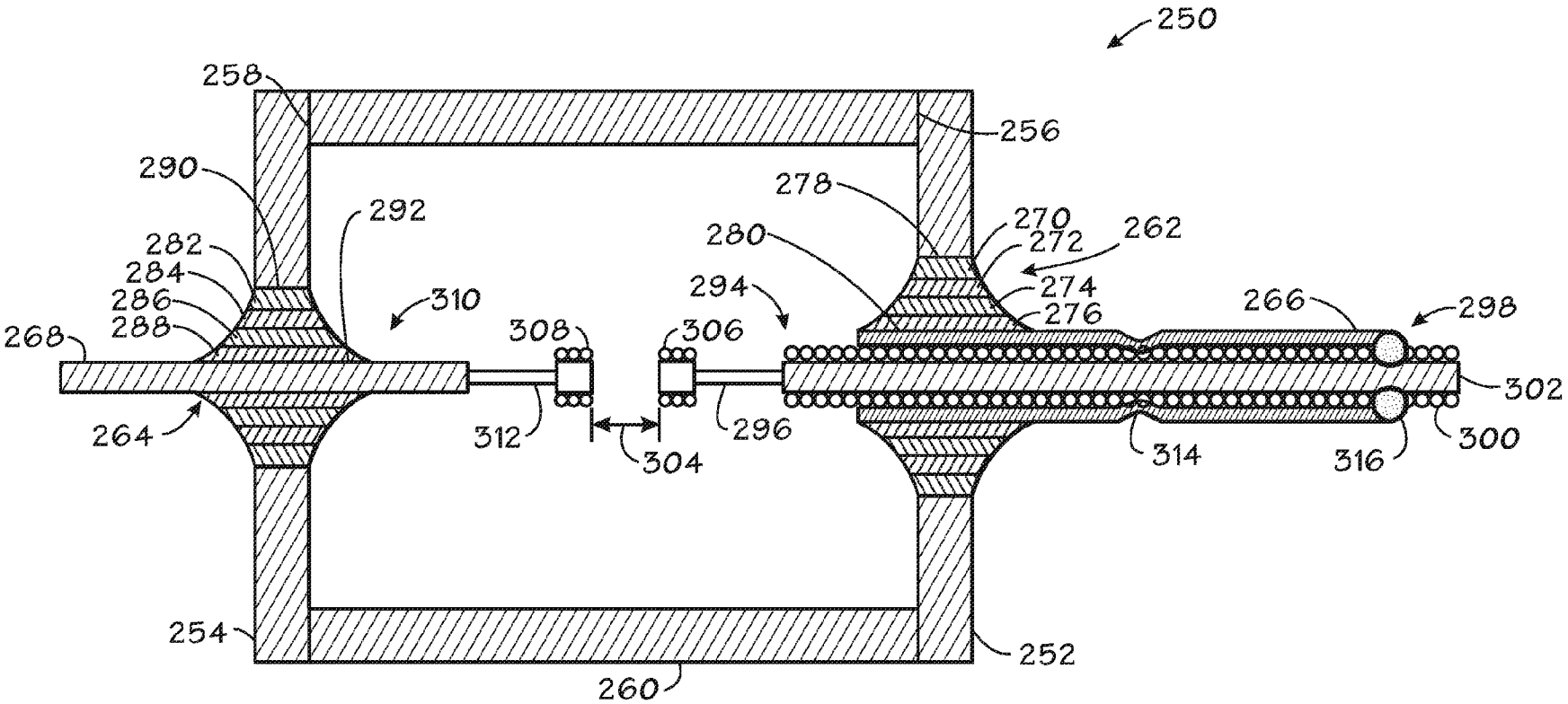
Figure 9:
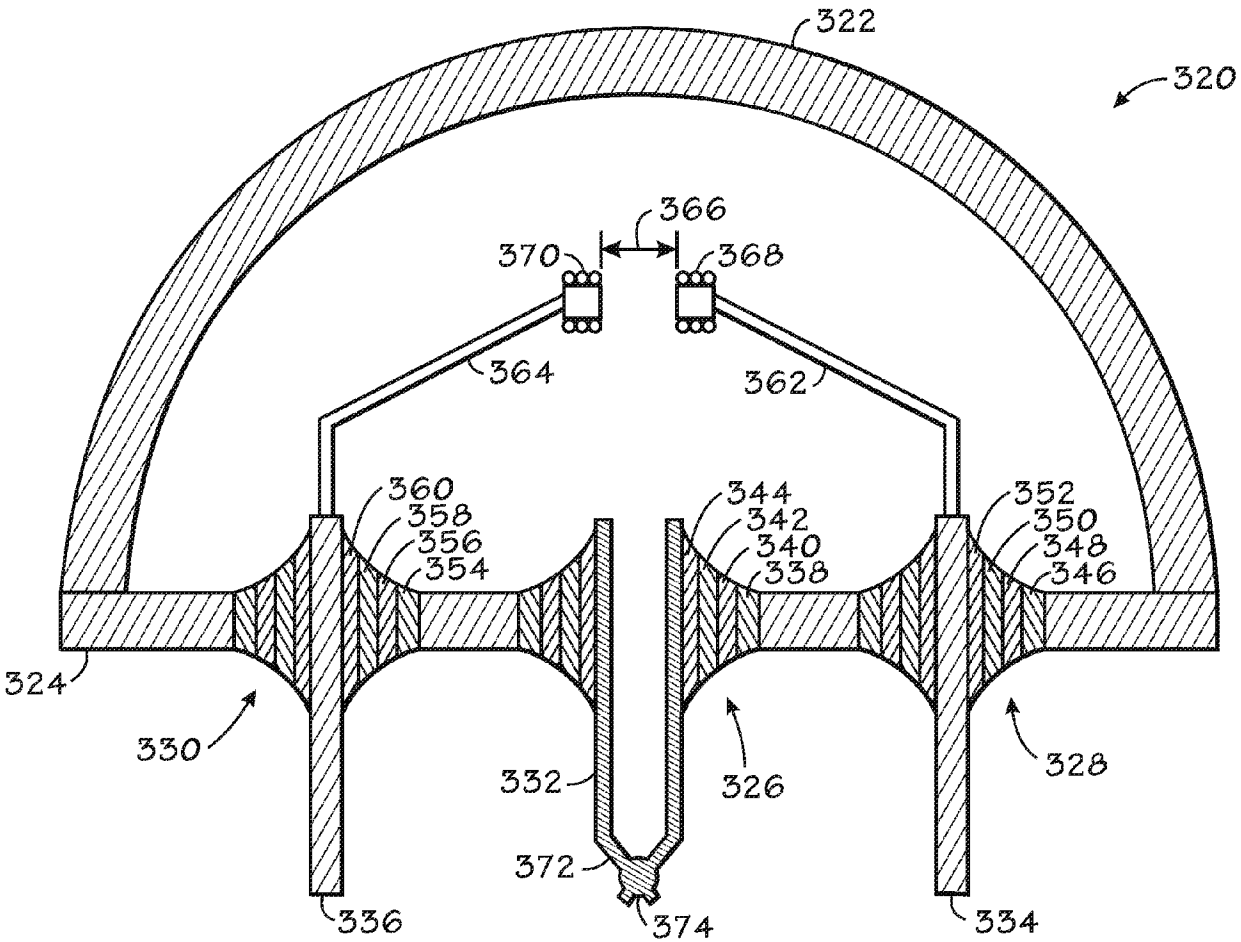
Figure 10:
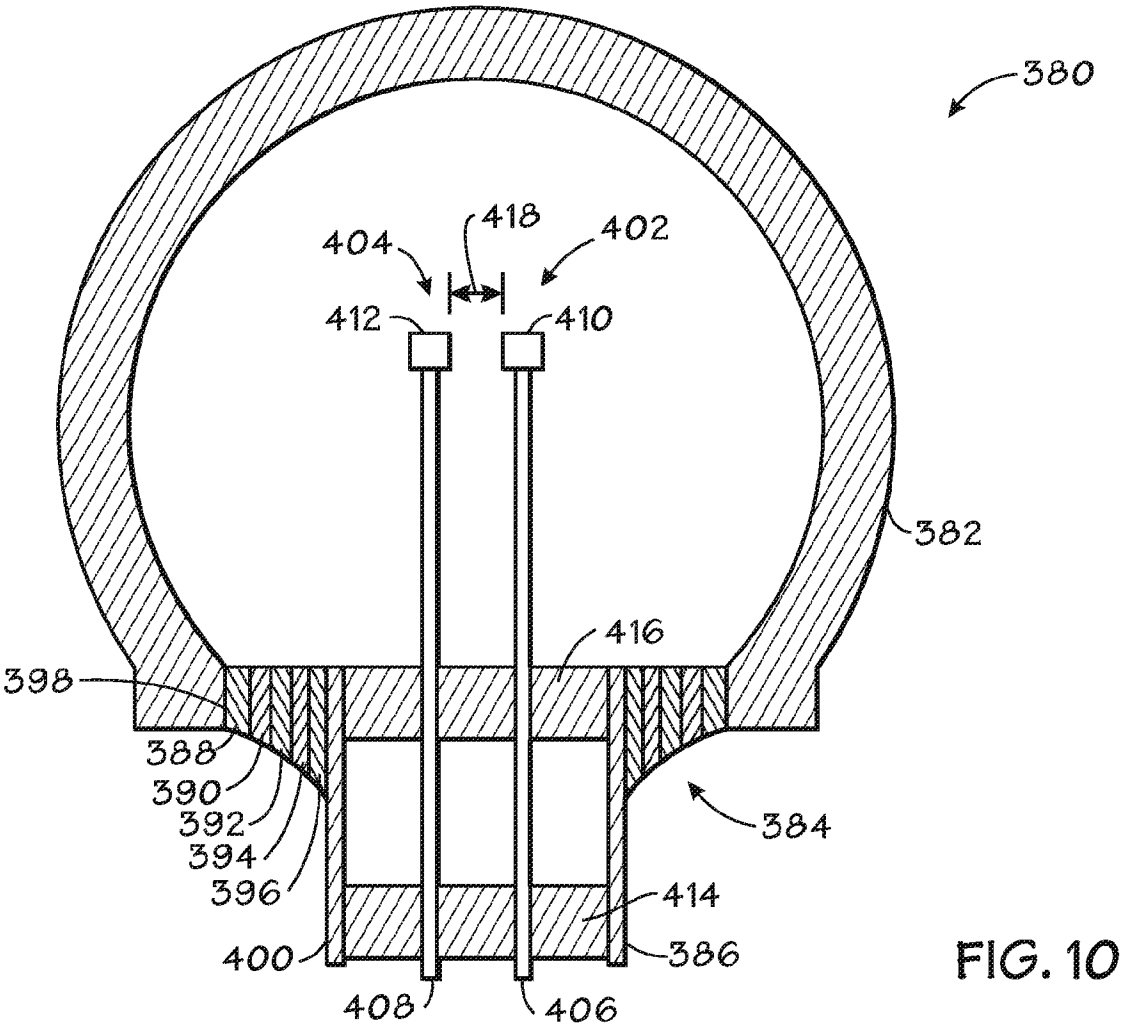
Figure 11:
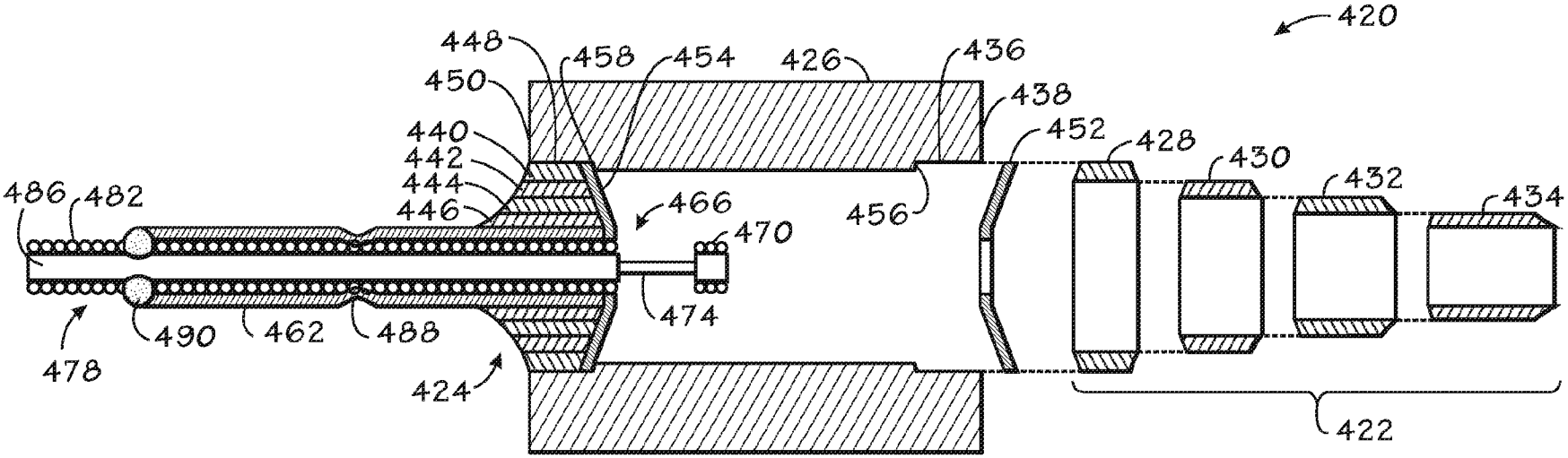
Figure 12:
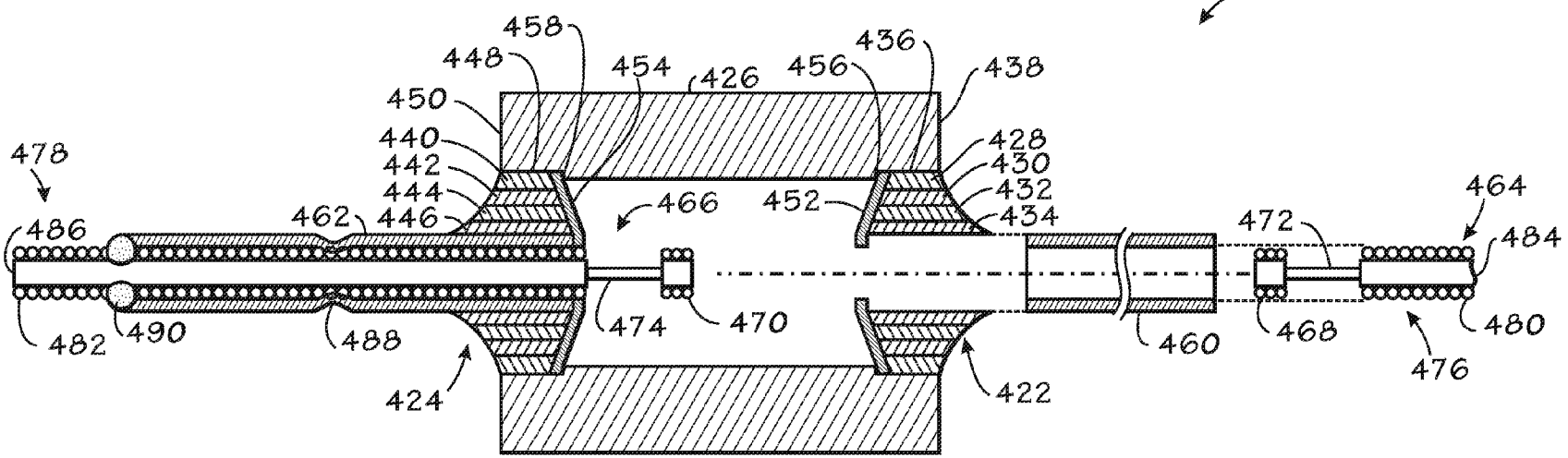
Figure 13:
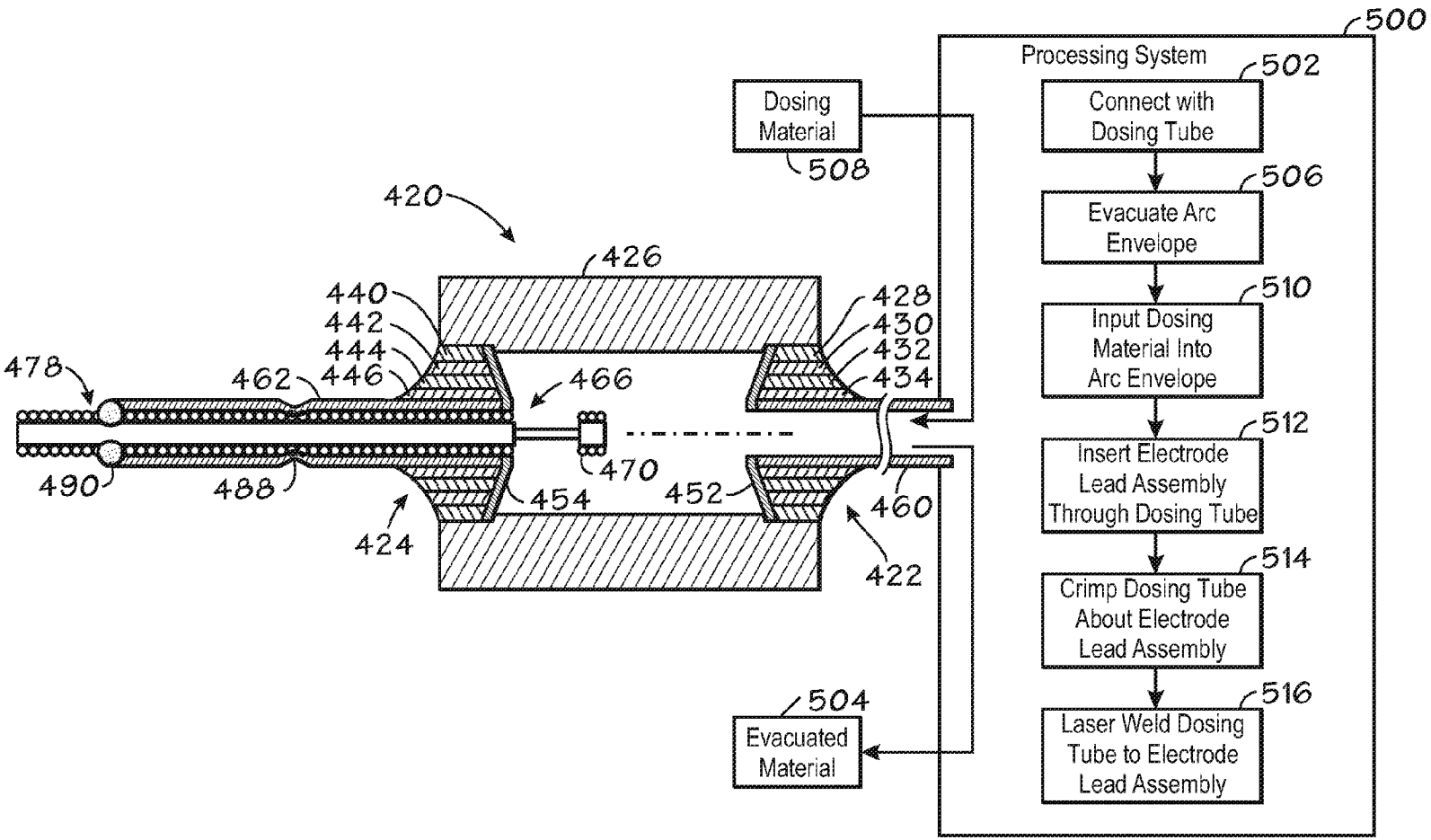
Figure 14:
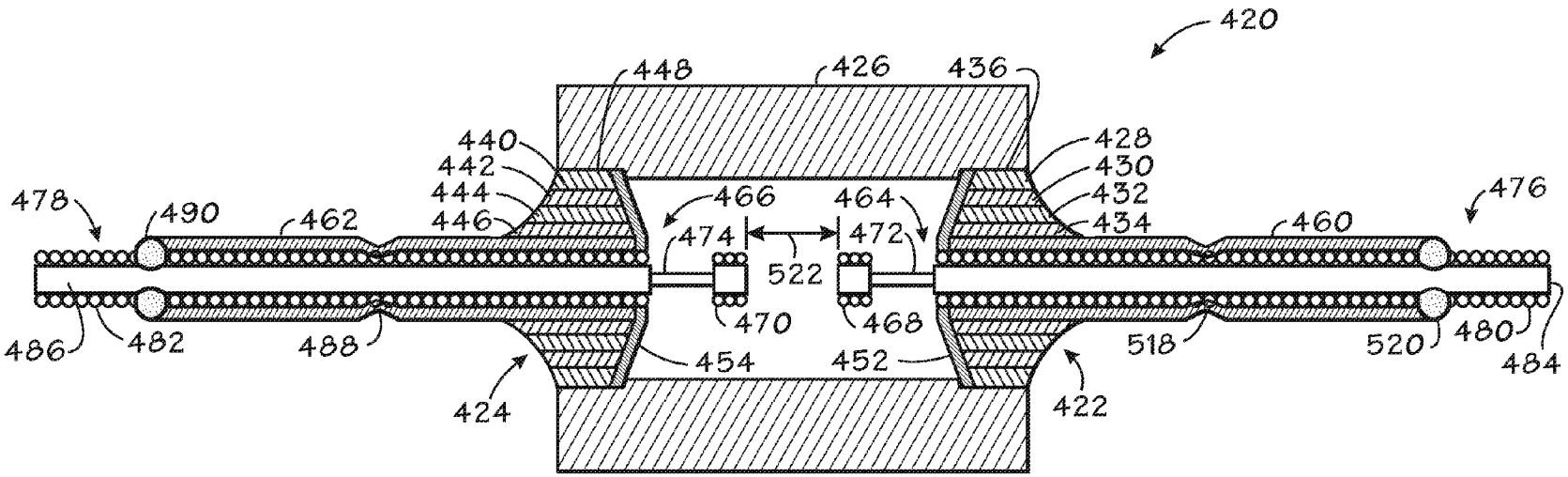

FIG. 5 is a cross-sectional side view of another embodiment of the lamp assembly as illustrated in FIGS. 1 and 2, wherein an end cap is disposed about each of the dosing tubes and the compliant seal is disposed between the arc envelope and the respective end caps, and each compliant seal includes a plurality of concentric layers disposed between the arc envelope and the respective dosing tube and a plurality of axially adjacent layers disposed between the arc envelope and the respective end cap;

FIG. 6 is an exploded view of an exemplary embodiment of the axially adjacent layers as illustrated in FIG. 5, wherein each of the axially adjacent layers includes a ring-shaped member having circumferentially staggered expansion slots;

FIG. 7 is a top view of the ring-shaped members of the compliant seal as illustrated in FIGS. 5 and 6, wherein the ring-shaped members are stacked one over the other in a circumferentially staggered configuration in which the expansion slots are staggered circumferentially by about forty five degrees from one ring-shaped member to another within the stack of ring-shaped members;

FIG. 8 is a cross-sectional side view of a further embodiment of the lamp assembly as illustrated in FIGS. 1 and 2, wherein a pair of end caps are coupled to opposite ends of an arc envelope, a compliant seal is disposed about an electrode lead extending through one of the end caps, and a compliant seal is disposed about a dosing tube extending through the other end cap;

FIG. 9 is a cross-sectional side view of an alternative lamp assembly having a dome-shaped arc envelope, an end cap coupled to the arc envelope, and a dosing tube and a pair of electrode leads extending through the end cap, wherein a compliant seal is disposed about each of the electrodes leads and the dosing tube through the end cap in accordance with certain embodiments of the present technique;

FIG. 10 is a cross-sectional side view of an alternative lamp assembly having a semi-spherical or bulb-shaped arc envelope, a dosing tube coupled to the arc envelope via a compliant seal, and a pair of electrode leads extending through the dosing tube in accordance with certain embodiments of the present technique;

FIG. 11 is a partially exploded cross-sectional side view of an alternative embodiment of the lamp assembly as illustrated in FIGS. 1 and 2, wherein a corrosion protective cover and a plurality of concentric sealing sleeves are exploded from an annular recess in the arc envelope in accordance with embodiments of the present technique;

FIG. 12 is a partially exploded cross-sectional side view of the lamp assembly as illustrated in FIG. 11, wherein the corrosion protective cover and the concentric sealing sleeves are disposed within the annular recess of the arc envelope, and a dosing tube and an arc electrode assembly are exploded from the concentric sealing sleeves in accordance with certain embodiments of the present technique;

FIG. 13 is a cross-sectional side view of the lamp assembly as illustrated in FIG. 12, wherein the dosing tube is coupled to the arc envelope via the concentric sealing sleeves and is coupled to a processing system for evacuating and dosing the lamp assembly in accordance with certain embodiments of the present technique; and FIG. 14 is a cross-sectional side view of the lamp assembly as illustrated in FIG. 13, wherein the arc electrode assembly extends through the dosing tube, and the dosing tube is crimped and laser welded to the arc electrode assembly in accordance with certain embodiments of the present technique.

DETAILED DESCRIPTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliant with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

In each of the following embodiments, one or more compliant seals may be disposed between various components of a lamp, wherein each compliant seal includes a plurality of concentric sleeves, adjacent rings, side-by-side sheets, or layers. The layers of the compliant seal generally include different thermal expansion characteristics, which gradually change from one layer to another between the adjacent components being sealed together. In other words, in the present application, the thermal expansion characteristics may be defined as different abilities to expand and/or contract in response to temperature changes. Moreover, the thermal expansion characteristics may be defined as material characteristics, geometrical characteristics, or combinations thereof. For example, the material characteristics may include the coefficient of thermal expansion, or the elastic modulus (i.e., Young's modulus), or other thermo-mechanical characteristics of the layers. In certain embodiments, the layers may have gradually changing (i.e., in steps) coefficients of thermal expansion within a range from $3\times10^{-6}$/Kelvin to $12\times10^{-6}$/Kelvin, or within a smaller range from $5\times10^{-6}$/Kelvin to $9\times10^{-6}$/Kelvin. By further example, the geometrical characteristics may include wall thickness, length, width, diameter, solidity or continuity (e.g., number of interruptions, spaces, slots, openings, grooves, channels, etc.), and so forth. In certain embodiments, the layers each may have an equal or different number, size, and configuration of expansion/contraction spaces. In each of the embodiments discussed in further detail below, the different layers of the compliant seals may have different thermal expansion characteristics based solely on material characteristics, or based solely on geometrical characteristics (e.g., spaces or slots), or based both on material and geometrical characteristics. These compliant seals are particularly useful in rapid cycling of lamps, where the temperatures change and cause expansion and contraction in the various components.

FIGS. 1 and 2 are cross-sectional side views of an exemplary lamp assembly 10, such as a high intensity discharge (HID) lamp assembly, having a pair of compliant seals 12 and 14 in accordance with certain embodiments of the present technique. As illustrated, the compliant seals 12 and 14 are disposed between an arc envelope 16 and a pair of dosing tubes 18 and 20 extending into opposite open ends 22 and 24 of the arc envelope 16. In the embodiment of FIG. 1, the arc envelope 16 has a tubular or cylindrical shaped geometry, whereas the arc envelope 16 has a curved, oval, semi-spherical, or bulb-shaped geometry in the embodiment of FIG. 2. However, the arc envelope 16 may have a variety of other shapes and configurations in other embodiments of the present technique.

Turning now to the commonalties in FIGS. 1 and 2, the compliant seal 12 includes a plurality of concentric layers or sleeves 26, 28, 30, and 32 disposed between a cylindrical interior surface 34 of the arc envelope 16 and a cylindrical exterior surface 36 of the dosing tube 18. Similarly, the compliant seal 14 includes a plurality of concentric layers or sleeves 38, 40, 42, and 44 disposed between a cylindrical interior surface 46 of the arc envelope 16 and a cylindrical exterior surface 48 of the dosing tube 20. In the illustrated embodiments of FIGS. 1 and 2, the compliant seals 12 and 14 directly couple the dosing tubes 18 and 20 to the opposite open ends 22 and 24 of the arc envelope 16 without any intermediate structure, such as an end cap or an end plug. However, in other embodiments as discussed in detailed below, the compliant seals 12 and 14 may be disposed between the arc envelope 16 and an end plug or end cap, or between the dosing tubes 18 and 20 and corresponding end caps or end plugs, or between electrode assemblies and corresponding end caps or end plugs, or between other components of the lamp assembly 10. Moreover, the compliant seals may include a plurality of layers one after another in an axial direction, a radial direction, or a combination thereof.

The concentric layers or sleeves 26, 28, 30, and 32 of the compliant seal 12 and the concentric layers or sleeves 38, 40, 42, and 44 of the compliant seal 14 generally include different thermal expansion characteristics, which gradually change from one layer/sleeve to another between the arc envelope 16 and the dosing tubes 18 and 20. Again, in the present application, the thermal expansion characteristics may be defined as different abilities to expand and/or contract in response to temperature changes. Moreover, the thermal expansion characteristics may be defined as material characteristics, geometrical characteristics, or combinations thereof. For example, the material characteristics may include the coefficient of thermal expansion, or the elastic modulus (i.e., Young's modulus), and so forth. In certain embodiments, the sleeves 26, 28, 30, and 32 and the sleeves 38, 40, 42, and 44 may have gradually changing (i.e., in steps) coefficients of thermal expansion within a range from $3\times10^{-6}$ Kelvin to $12\times10^{-6}$/Kelvin, or within a smaller range from $5\times10^{-6}$/Kelvin to $9\times10^{-6}$/Kelvin. By further example, the geometrical characteristics may include wall thickness, length, width, diameter, solidity or continuity (e.g., number of interruptions, spaces, slots, openings, grooves, channels, etc.) of the sleeves 26, 28, 30, and 32 and the sleeves 38, 40, 42, and 44. In certain embodiments, the sleeves 26, 28, 30, and 32 and the sleeves 38, 40, 42, and 44 each may have an equal or different number, size, and configuration of expansion/contraction spaces. Again, the different layers or sleeves of the compliant seals 12 and 14 may have different thermal expansion characteristics based solely on material characteristics (e.g., different cermets—e.g., alumina molybdenum cermets), or based solely on geometrical characteristics (e.g., spaces or slots), or based both on material and geometrical characteristics. In this manner, the compliant seals 12 and 14 improve the interface or compliance (e.g., thermal, mechanical, etc.) between the properties or behavior of the arc envelope 16 and the dosing tubes 18 and 20 during operation of the lamp assembly 10, and particularly during rapid cycling or thermal variations in the lamp assembly 10.

In the illustrated embodiment, the concentric layers or sleeves 26, 28, 30, and 32 of the compliant seal 12 include four different materials having different thermal expansion characteristics that provide a four stage gradual change between the thermal characteristics of a first material composition of the arc envelope 16 and the thermal characteristics of a second material composition of the dosing tube 18. For example, the concentric layer of sleeve 26 may have properties or thermal characteristics more closely matched with those of the arc envelope 16, while the concentric layer or sleeve 32 may have properties or thermal characteristics more closely matched with those of the dosing tube 18. In turn, the intermediate concentric layers or sleeves 28 and 30 may have properties or thermal characteristics in between those of the concentric layers or sleeves 26 and 32. In other words, each of the concentric layers or sleeves 26, 28, 30, and 32 of the compliant seal 12 provide an incremental change in the properties or thermal characteristics between the arc envelope 16 and the dosing tube 18, rather than a more abrupt change from the arc envelope 16 to a single sealing layer to the dosing tube 18. The concentric layers or sleeves 38, 40, 42, and 44 of the compliant seal 14 are also configured to provide a gradual or incremental change in the properties or thermal expansion characteristic from the arc envelope 16 to the dosing tube 20.

Regarding the material compositions of these components, in certain embodiments, the first material composition of the arc envelope 16 includes a variety of transparent ceramics and other materials, such as yttrium-aluminum-garnet, ytterbium-aluminum-garnet, or other lanthanide aluminum garnets, microgram polycrystalline alumina (μPCA), alumina or single crystal sapphire, yttria, spinel, ytterbia, or combinations thereof. Other embodiments of the arc envelope 16 are formed from conventional lamp materials, such as polycrystalline alumina (PCA). The second material composition of the dosing tubes 18 and 20 may include one or more metals (e.g., molybdenum, or rhenium, or tungsten, or a molybdenum-rhenium alloy, or a tungsten-rhenium alloy, or niobium, or combinations thereof), a cermet, or combinations thereof. For example, one exemplary molybdenum-rhenium alloy includes molybdenum and 44 percent by volume rhenium. Advantageously, certain embodiments of the dosing tubes 18 and 20 are formed of materials, e.g., molybdenum-rhenium alloys, that provide stability at high temperatures and pressures, stability against corrosive materials such as hot halide vapors, and ductility for cold welding the dosing tubes 18 and 20. An exemplary molybdenum-rhenium alloy includes about 35 to 55 percent weight of rhenium, or about 44 to 48 percent weight of rhenium.

Turning to the material composition of the compliant seals 12 and 14, the concentric layers or sleeves 26, 28, 30, and 32 of the compliant seal 12 and the concentric layers or sleeves 38, 40, 42, and 44 of the compliant seal 14 may include different ceramics (e.g., alumina, or yttrium-aluminum-garnet, i.e., YAG, or ceramic compositions based on rare earth oxides, alumina, and silica), or different cermets (e.g., alumina molybdenum cermets), or different combinations thereof. It should be noted that the material compositions described for any one of the compliant seals may be used for the other complaints seals disclosed herein. In certain embodiments, the layers or sleeves of the compliant seals 12 and 14 may be formed with the same material in different geometrical configurations, e.g., different degrees of continuity or interruptions (e.g., slots), as discussed in further detail below with reference to FIG. 3. Some embodiments of the compliant seals 12 and 14 may include more or fewer of the concentric layers or sleeves. For example, the compliant seals 12 and 14 may include 2, 3, 4, 5, 6, 7, 8, 9, 10, or more layers or sleeves as suitable for a particular interface between the dosing tubes 18 and 20 and the arc envelope 16.

The compliant seals 12 and 14 also may have a variety of lengths, thicknesses, diameters, or geometrical configurations in accordance with certain embodiments of the present technique. For example, the concentric layers or sleeves 26, 28, 30, and 32 of the compliant seal 12 and the concentric layers or sleeves 38, 40, 42, and 44 of the compliant seal 14 have incrementally greater lengths and incrementally smaller diameters from the arc envelope 16 to the dosing tubes 18 and 20. The thickness of the concentric layers or sleeves also may gradually increase, remain constant, or decrease from one layer or sleeve to another between the arc envelope 16 and the dosing tubes 18 and 20.

A few specific combinations of material compositions for the various parts of the embodiments of FIGS. 1 and 2 are now described for illustrative purposes. For example, in one specific embodiment, the arc envelope 16 has a material composition including alumina, the dosing tubes 18 and 20 have a material composition including molybdenum and 44 percent by volume rhenium, and the layers or sleeves 26/38, 28/40, 30/42, and 32/44 have material compositions including alumina molybdenum cermets. Specific embodiments of these layers or sleeves 26/38, 28/40, 30/42, and 32/44 are formed of alumina molybdenum cermets, including alumina and 8 percent by volume molybdenum, alumina and 22 percent by volume molybdenum, alumina and 36 percent by volume molybdenum, and alumina and 50 percent by volume molybdenum, respectively.

Figure 3:
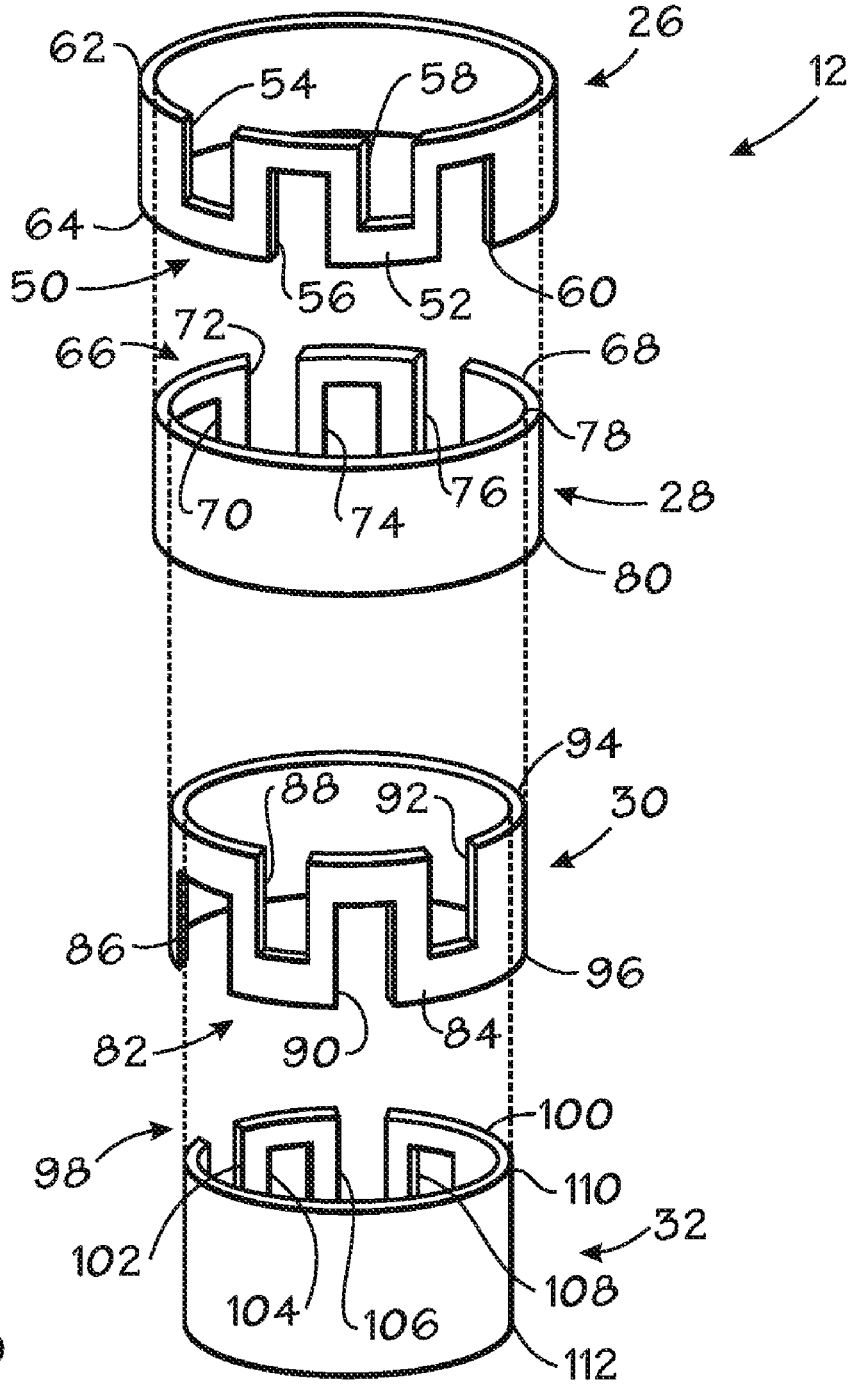
FIG. 3 is an exploded perspective view of an exemplary embodiment of the compliant seal as illustrated in FIGS. 1 and 2, wherein the plurality of layers are defined by a plurality of concentric sleeves having staggered expansion slots.

FIG. 3 is an exploded perspective view of an exemplary embodiment of the compliant seal 12 as illustrated in FIGS. 1 and 2, wherein the concentric layers or sleeves 26, 28, 30, and 32 include concentrically staggered expansion slots. For example, the concentric layer or sleeve 26 includes a set of thermal expansion slots 50 disposed one after another along a front or first circumferential portion 52 of the sleeve 26. The illustrated set of thermal expansion slots 50 includes four axial slots 54, 56, 58, and 60, wherein the axial slots 54 and 58 extend into the sleeve 26 from a top side 62 and the axial slots 56 and 60 extend into the sleeve 26 from a bottom side 64. Thus, the axial slots 54, 56, 58, and 60 are circumferentially staggered one after the other relative to the top and bottom sides 62 and 64 of the sleeve 26.

Moreover, the set of thermal expansion slots 50 is circumferentially staggered relative to a set of thermal expansion slots 66 in the concentric layer or sleeve 28. As illustrated, the set of thermal expansion slots 66 is disposed on a rear or opposite circumferential portion 68 relative to the front 52 of the sleeve 26. Again, the set of thermal expansion slots 66 includes four axial slots 70, 72, 74, and 76, which are staggered one after another relative to top and bottom sides 78 and 80 of the sleeve 28.

The subsequent sleeve 30 has a configuration similar to the first sleeve 26. As illustrated, the sleeve 30 includes a set of thermal expansion slots 82 disposed along a front circumferential portion 84 of the sleeve 30, similar to the frontal arrangement of the sleeve 26. The set of thermal expansion slots 82 includes four axial slots 86, 88, 90, and 92, which are circumferentially staggered one after another between top and bottom sides 94 and 96 of the sleeve 30. In addition, in the illustrated embodiment, the axial slots 86, 88, 90, and 92 may be disposed in an axially opposite configuration as the axial slots 54, 56, 58, and 60 of the sleeve 26. In other words, the axial slots 86 and 90 extend into the sleeve 30 from the bottom side 96 rather than the top side 94, and the axial slots 88 and 92 extend into the sleeve 30 from the top side 94 rather than the bottom side 96.

Finally, the sleeve 32 has a set of thermal expansion slots 98 disposed in a similar configuration as the sleeve 28. As illustrated, the set of thermal expansion slots 98 is disposed on a rear circumferential portion 100 of the sleeve 32, which is opposite from the front circumferential portions 52 and 84 of the sleeves 26 and 30. The set of thermal expansion slots 98 includes four axial slots 102, 104, 106, and 108, which are circumferentially staggered one after another between top and bottom sides 110 and 112 of the sleeve 32. In the illustrated embodiment, the axial slots 102, 104, 106, and 108 are disposed in an axially opposite configuration relative to the axial slots 70, 72, 74, and 76 of the sleeve 28.

The circumferential staggering of the various sets of thermal expansion slots 50, 66, 82, and 98 ensures that the compliant seal 12 is sealed in the axial, radial, and circumferential directions between the arc envelope 16 and the dosing tube 18. The compliant seal 14 may have a similar configuration as the compliant seal 12 as illustrated in FIG. 3. Moreover, the compliant seals 12 and 14 may have a variety of equal or different numbers, lengths, widths, and configurations of expansion slots in various embodiments of the present technique. For example, the sets of thermal expansion slots 50, 66, 82, and 98 may each include 1, 2, 3, 4, 5, 6, 7, 8, 9, 10, or more slots extending from the top, the bottom, or the top and bottom of the respective sleeves. In operation of the lamp assembly 10, these sets of thermal expansion slots 50, 66, 82, and 98 enable the sleeves 26, 28, 30, and 32 of the compliant seal 12 to expand and/or contract relative to one another in response to different behaviors of the layers 26, 28, 30, and 32, the arc envelope 16, and the dosing tube 18. For example, although four different materials in the respective the layers or sleeves 26, 28, 30, and 32 provide a gradual change (e.g., four intermediate steps instead of a single intermediate step) in thermal expansion characteristics between the arc envelope 16 and the dosing tube 18, the sets of thermal expansion slots 50, 66, 82, and 98 further improve or smoothen the transition between the successive layers or sleeves 26, 28, 30, and 30. In this manner, the sets of thermal expansion slots 50, 66, 82, and 98 can substantially reduce thermal stresses across the compliant seal 12 between the arc envelope 16 and the dosing tube 18. Again, the thermal expansion slots 50, 66, 82, and 98 may be used with identical or different material compositions in the various sleeves 26, 28, 30, and 32. The compliant seal 14 also may have a similar configuration as illustrated in FIG. 3.

Referring back to FIGS. 1 and 2, the illustrated lamp assembly 10 includes arc electrode assemblies 114 and 116 coupled to the dosing tubes 18 and 20, respectively. The arc electrode assemblies 114 and 116 include arc electrodes 118 and 120 coupled to electrode lead assemblies 122 and 124, respectively. The arc electrodes 118 and 120 further include arc tips 126 and 128, and the electrode lead assemblies 122 and 124 include wire overwraps 130 and 132 disposed about mandrels or shanks 134 and 136, respectively.

In the illustrated embodiment, the arc electrode assemblies 114 and 116 are moved lengthwise along the interior of the dosing tubes 18 and 20 until the desired arc gap 138 is achieved between the arc tips 126 and 128. Upon reaching the desired arc gap 138, the arc electrode assemblies 114 and 116 are secured to the dosing tubes 18 and 20 by crimping intermediate portions 140 and 142 and laser welding outer end portions 144 and 146 of the dosing tubes 18 and 20 relative to the electrode lead assemblies 122 and 124, respectively. In certain embodiments, the dosing tubes 18 and 20 are crimped or mechanically compressed about the electrode lead assemblies 122 and 124 at other locations or at multiple locations along the dosing tubes 18 and 20. Moreover, one or more other forms of focused heating, such as induction heating, may be applied to seal the dosing tubes 18 and 20 to the electrode lead assemblies 122 and 124. The laser welding, crimping, induction heating, and other sealing techniques may be used alone or in combination with one another.

In certain embodiment, the dosing tubes 18 and 20 and the electrode lead assemblies 122 and 124 have material compositions to facilitate the forgoing crimping and laser welding techniques. For example, the dosing tubes 18 and 20 may include one or more metals (e.g., molybdenum, or rhenium, or tungsten, or a molybdenum-rhenium alloy, or a tungsten-rhenium alloy, or niobium, or combinations thereof), a cermet, or combinations thereof. Similarly, the wire overwraps 130 and 132 may include molybdenum, or rhenium, or tungsten, or a molybdenum-rhenium alloy, or a tungsten-rhenium alloy, or combinations thereof. Finally, the mandrels or shanks 134 and 136 may include molybdenum, or rhenium, or tungsten, or a molybdenum-rhenium alloy, or a tungsten-rhenium alloy, or combinations thereof. The ductile nature of these materials, e.g., a molybdenum-rhenium alloy, enables the dosing tubes 18 and 20 to be substantially compressed around the circumference of the electrode lead assemblies 122 and 124 at the intermediate portions 140 and 142, respectively. The other components of the arc electrode assemblies 114 and 116 also may include a variety of material compositions. For example, the arc electrodes 118 and 120 may have a material composition including tungsten, or molybdenum, or rhenium, or combinations thereof. The arc tips 126 and 128 may have a material composition including tungsten, or molybdenum, or rhenium, or combinations thereof.

Figure 4:
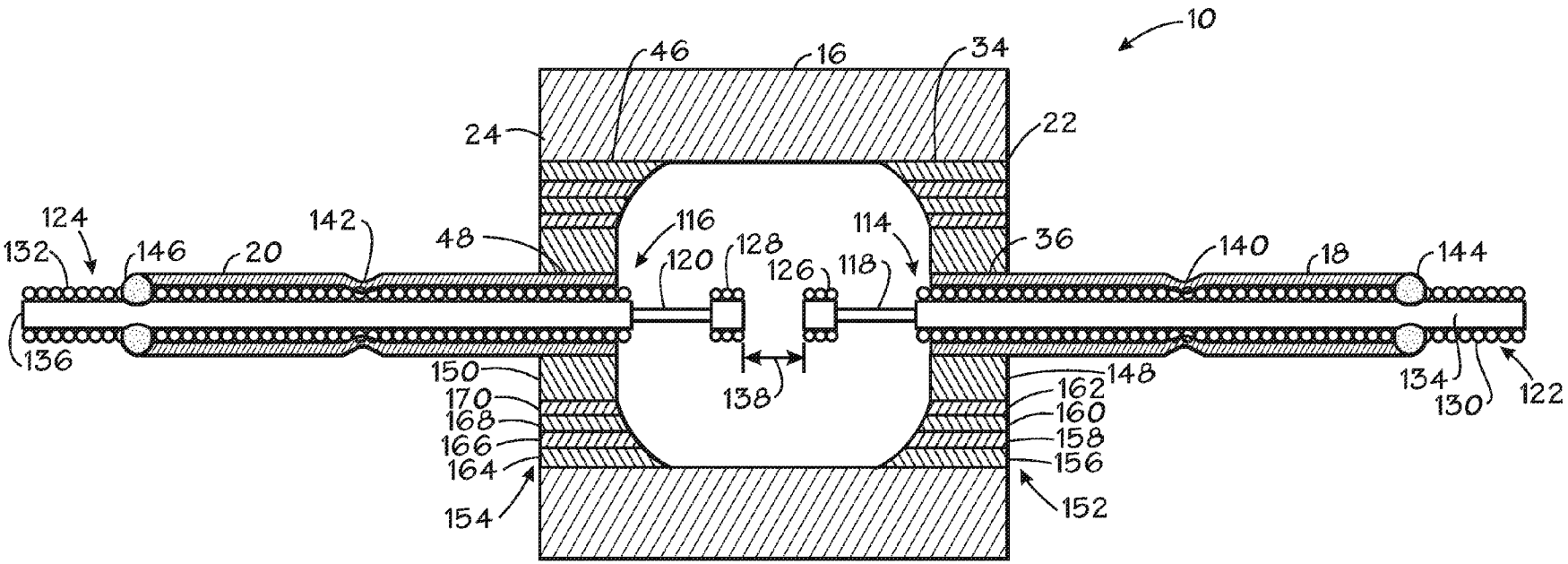
FIG. 4 is a cross-sectional side view of another embodiment of the lamp assembly as illustrated in FIGS. 1 and 2, wherein an end plug is disposed about each of the dosing tubes and the compliant seal is disposed between the arc envelope and the respective end plug.

FIG. 4 is a cross-sectional side view of an alternative embodiment of the lamp assembly 10 as illustrated in FIGS. 1 and 2, wherein the dosing tubes 18 and 20 extend through end plugs 148 and 150 coupled to (e.g., extending into and closing) the opposite open ends 22 and 24 of the arc envelope 16 via compliant seals 152 and 154, respectively. In other words, in the illustrated embodiment, the compliant seals 152 and 154 are disposed between (e.g., concentrically intermediate) the end plugs 148 and 150 and the respective open ends 22 and 24 of the arc envelope 16, rather than directly sealing the arc envelope 16 to the dosing tubes 18 and 20, respectively. Similar to the embodiments described above with reference to FIGS. 1 and 2, the compliant seal 152 includes concentric layers or sleeves 156, 158, 160, and 162, and the compliant seal 154 includes concentric layers or sleeves 164, 166, 168, and 170.

Again, the arc envelope 16, the dosing tubes 18 and 20, the end plugs 148 and 150, and the layers or sleeves of the compliant seals 152 and 154 may have a variety of similar or different material compositions. In the illustrated embodiment of FIG. 4, the arc envelope 16 and the end plugs 148 and 150 have different material compositions from one another, and the compliant seals 152 and 154 include different materials having different thermal expansion characteristics (e.g., different coefficients of thermal expansion, elastic modulus, degree of continuity—spaces, slots, etc.) that gradually change in a staged or incremental manner between the arc envelope 16 and the end plugs 148 and 150. In this manner, the lamp assembly 10 as illustrated in FIG. 4 has relatively gradual changes in thermal characteristics, thereby reducing thermal stresses and potential crack development within the lamp assembly 10 during operation at high temperatures and pressures.

For example, as discussed above, the illustrated arc envelope 16 has a material composition including a variety of transparent ceramics and other materials, such as yttrium-aluminum-garnet, ytterbium-aluminum-garnet, microgram polycrystalline alumina (μPCA), alumina or single crystal sapphire, yttria, spinel, ytterbia, or combinations thereof. Other embodiments of the arc envelope 16 are formed from conventional lamp materials, such as polycrystalline alumina (PCA). In contrast, the end plugs 148 and 150 have a nonceramic or different ceramic material composition, such as a cermet, a metal (e.g., molybdenum, or rhenium, or tungsten, or a molybdenum-rhenium alloy, or a tungsten-rhenium alloy, or niobium, or combinations thereof), or combinations thereof. The dosing tubes 18 and 20 also may include a material composition having thermal characteristics (e.g., coefficient of thermal expansion, elastic modulus, etc.) that are at least similar to those of the end plug 148 and 150. For example, the dosing tubes 18 and 20 may have a material composition including a cermet, or a metal (e.g., molybdenum, or rhenium, or tungsten, or a molybdenum-rhenium alloy, or a tungsten-rhenium alloy, or niobium, or combinations thereof), or combinations thereof. In one embodiment, the end plugs 148 and 150 are formed of a molybdenum rhenium alloy and the dosing tubes 18 and 20 are formed of the same or a different molybdenum rhenium alloy. In another embodiment, the end plugs 148 and 150 are formed of a molybdenum rhenium alloy and the dosing tubes 18 and 20 are formed of molybdenum. In a further embodiment, the end plugs 148 and 150 and the dosing tubes 18 and 20 are formed of molybdenum.

A specific combination of material compositions for the various parts is provided below as an example for the lamp assembly 10 of FIG. 4. For example, in one specific embodiment, the arc envelope 16 has a material composition including alumina, the dosing tubes 18 and 20 have a material composition including molybdenum and 44 percent by volume rhenium, the end plugs 148 and 150 have a material composition including molybdenum and 44 percent by volume rhenium, and the layers or sleeves 156/164, 158/166, 160/168, and 162/170 have material compositions including alumina molybdenum cermets, respectively. Specific embodiments of these layers or sleeves 156/164, 158/166, 160/168, and 162/170 are formed of alumina molybdenum cermets, including alumina and 8 percent by volume molybdenum, alumina and 22 percent by volume molybdenum, alumina and 36 percent by volume molybdenum, and alumina and 50 percent by volume molybdenum, respectively.

FIG. 5 is a cross-sectional side view of another alternative embodiment of the lamp assembly 10 as illustrated in FIG. 1, wherein a first pair of compliant seals 172 and 174 is disposed concentrically or radially between the arc envelope 16 and the dosing tubes 18 and 20 and a second pair of compliant seals 176 and 178 is disposed axially between the arc envelope 16 and opposite end caps 180 and 182. Similar to the embodiments of FIGS. 1 and 2, the compliant seal 172 includes a plurality of concentric layers or sleeves 184, 186, 188, and 190, and the compliant seal 174 includes a plurality of concentric layers or sleeves 192, 194, 196, and 198. In this concentrically layered manner, the compliant seals 172 and 174 provide a gradual change in properties or thermal expansion characteristics (e.g., coefficients of thermal expansion, elastic modulus, geometry or continuity—i.e., spaces or slots) in a radial direction between the dosing tubes 18 and 20 and the surrounding arc envelope 16.

In a similar manner, the compliant seals 176 and 178 provide a gradual change in properties or thermal expansion characteristics (e.g., coefficients of thermal expansion, elastic modulus, geometry or continuity—i.e., spaces or slots) in an axial direction between the arc envelope 16 and the end caps 180 and 182. Specifically, the illustrated compliant seal 176 includes a plurality of axially adjacent layers or rings 200, 202, 204, and 206, and the compliant seal 178 includes a plurality of axially adjacent layers or rings 208, 210, 212, and 214. The compliant seal 176 extends between a ring shaped end surface 216 of the arc envelope 16 and an interior ring shaped surface 218 of the end cap 180. Similarly, the compliant seal 178 extends between a ring shaped end surface 220 of the arc envelope 16 and an interior ring shaped surface 222 of the end cap 182.

Again, the compliant seals 172 and 174 accommodate differences in the properties or thermal expansion characteristics of the arc envelope 16 and the dosing tubes 18 and 20, while the compliant seals 176 and 178 accommodate differences in the properties or thermal expansion characteristics between the arc envelope 16 and the end caps 180 and 182. For example, the illustrated arc envelope 16 has a ceramic material composition, whereas the dosing tubes 18 and 20 and the end caps 180 and 182 have non-ceramic or other different types of ceramic compositions. Each of the compliant seals 172, 174, 176, and 178 includes four different materials having properties or thermal expansion characteristics (e.g., different coefficients of thermal expansion, elastic modulus, geometry or continuity—e.g., slots or spaces) that gradually change between the adjacent components, thereby reducing thermal stresses and potential stress crack development in the lamp assembly 10 between the various components.

The lamp assembly 10 as illustrated in FIG. 5 may have a variety of material compositions for the arc envelope 16, the dosing tubes 18 and 20, the end caps 180 and 182, and the compliant seals 172, 174, 176, and 178. In certain embodiments, the arc envelope 16 has a ceramic material composition, the end caps 180 and 182 have a cermet or niobium material composition, and the dosing tubes 18 and 20 have a molybdenum-rhenium alloy composition. In a first specific embodiment, the arc envelope 16 has a material composition including alumina, the end caps 180 and 182 have a material composition including molybdenum, and the dosing tubes 18 and 20 have a material composition including molybdenum and rhenium (e.g., a molybdenum-rhenium alloy). In this first specific embodiment, the layers or sleeves 184/192, 186/194, 188/196, and 190/198 of the compliant seals 172 and 174 include alumina molybdenum cermets, e.g., alumina and 8 percent by volume molybdenum, alumina and 22 percent by volume molybdenum, alumina and 36 percent by volume molybdenum, and alumina and 50 percent by volume molybdenum, in order from the arc envelope 16 to the dosing tubes 18 and 20. In addition, the layers or rings 200/208, 202/210, 204/212, and 206/214 of the compliant seals 176 and 178 have four different material compositions including alumina molybdenum cermets, e.g., alumina and 20 percent by volume molybdenum, alumina and 40 percent by volume molybdenum, alumina and 60 percent by volume molybdenum, and alumina and 80 percent by volume molybdenum, in order from the arc envelope 16 to the end caps 180 and 182.

In a second specific embodiment, the arc envelope 16 has a material composition including alumina, the end caps 180 and 182 have a material composition including Mo-44Re, and the dosing tubes 18 and 20 have a material composition including Mo-44Re. In this second specific embodiment, the layers or sleeves 184/192, 186/194, 188/196, and 190/198 of the compliant seals 172 and 174 include alumina molybdenum cermets, e.g., alumina and 8 percent by volume molybdenum, alumina and 22 percent by volume molybdenum, alumina and 36 percent by volume molybdenum, and alumina and 50 percent by volume molybdenum, in order from the arc envelope 16 to the dosing tubes 18 and 20. In addition, the layers or rings 200/208, 202/210, 204/212, and 206/214 of the compliant seals 176 and 178 have four different material compositions including alumina molybdenum cermets, e.g., alumina and 8 percent by volume molybdenum, alumina and 22 percent by volume molybdenum, alumina and 36 percent by volume molybdenum, and alumina and 50 percent by volume molybdenum, in order from the arc envelope 16 to the end caps 180 and 182.

In a third specific embodiment, the arc envelope 16 has a material composition including alumina, the end caps 180 and 182 have a material composition including alumina, and the dosing tubes 18 and 20 have a material composition including Mo-44Re. In this third specific embodiment, the layers or sleeves 184/192, 186/194, 188/196, and 190/198 of the compliant seals 172 and 174 include alumina molybdenum cermets, e.g., alumina and 8 percent by volume molybdenum, alumina and 22 percent by volume molybdenum, alumina and 36 percent by volume molybdenum, and alumina and 50 percent by volume molybdenum, in order from the arc envelope 16 to the dosing tubes 18 and 20. In addition, the layers or rings 200/208, 202/210, 204/212, and 206/214 of the compliant seals 176 and 178 have four different material compositions including dysprosia-alumina-silica seal rings, e.g., 74.5 wt % dysprosia-18.5 wt % alumina-7 wt % silica, 72 wt % dysprosia-16 wt % alumina-12 wt % silica, 69.5 wt % dysprosia-13.5 wt % alumina-17 wt % silica, and 67 wt % dysprosia-11 wt % alumina-22 wt % silica, in order from the arc envelope 16 to the end caps 180 and 182.

FIG. 6 is an exploded view of an exemplary embodiment of the compliant seal 176 as illustrated in FIG. 5, wherein each of the axially adjacent layers or rings 200, 202, 204, and 206 include one or more thermal expansion slots. For example, in the illustrated embodiment, each of the axially adjacent layers or rings 200, 202, 204, and 206 includes four sets of three circumferentially staggered thermal expansion slots disposed at four circumferential locations, e.g., 90 degree increments, about the circumference of the respective rings 200, 202, 204, and 206. Moreover, the four sets of three circumferentially staggered expansion slots are staggered by about forty five degrees from one ring to another within the series of rings 200, 202, 204, and 206. For example, the rings 200 and 204 include four sets of three circumferentially staggered thermal expansion slots 224, while the rings 202 and 206 include four sets of circumferentially staggered thermal expansion slots 226. Similar to the sleeves 26, 28, 30, and 32 of the compliant seal 12 as illustrated and discussed above with reference to FIG. 3, the rings 200, 202, 204, and 206 of the compliant seal 176 are stacked one over the other with the slots 224 and 226 in a circumferentially staggered configuration to provide a continuous seal in the axial, radial, and circumferential directions between the arc envelope 16 and the end caps 180 and 182.

FIG. 7 is a top view of the compliant seal 176 as illustrated in FIG. 6, further illustrating the circumferentially staggered configuration between the slots 224 and 226 in the rings 200, 202, 204, and 206. As illustrated, the slots 226 of the rings 202 and 206 mate with unslotted or solid portions of the rings 200 and 204 between the slots 224. Again, this circumferentially staggered configuration of the slots 224 and 226 enables expansion or contraction of the rings 200, 202, 204, and 206 of the compliant seal 176 during operation of the lamp assembly 10, thereby reducing thermal stresses and potential stress crack development between the arc envelope 16 and the end cap 180. In other embodiments, the rings 200, 202, 204, and 206 may have other numbers, lengths, widths, configurations, or geometries of slots or openings to facilitate expansion and contraction of compliant seal 176. In the illustrated embodiment, each of the slots sets 224 and 226 includes three slots, wherein two outer slots 228 and 230 extend from an outer diameter 232 toward an inner diameter 234 of the respective rings and a central slot 236 extends from the inner diameter 234 toward the outer diameter 232 of the respective rings.

FIG. 8 is a cross-sectional side view of an exemplary lamp assembly 250 having end caps 252 and 254 coupled to opposite ends 256 and 258 of an arc envelope 260, wherein compliant seals 262 and 264 are disposed about a dosing tube 266 and electrode lead 268 extending through the end caps 252 and 254, respectively. For example, the compliant seal 262 includes a plurality of concentric layers or sleeves 270, 272, 274, and 276 extending between a cylindrical interior surface 278 of the end cap 252 and a cylindrical exterior surface 280 of the dosing tube 266. Similarly, the compliant seal 264 includes a plurality of concentric layers or sleeves 282, 284, 286, and 288 extending between a cylindrical interior surface 290 of the end cap 254 and a cylindrical exterior surface 292 of the electrode lead 268, respectively.

Similar to the embodiments of FIGS. 1 and 2, the lamp assembly 250 includes an electrode assembly 294 having an arc electrode 296 coupled to an electrode lead assembly 298 extending through the dosing tube 266. Specifically, the electrode lead assembly 298 includes a wire overwrap 300 disposed about a mandrel or shank 302. For example, the wire overwrap 300 may include a single length of wire that is wound continuously around the mandrel or shank 302 along a substantial portion of its length and fit within the dosing tube 266. Advantageously, the electrode lead assembly 298 may be inserted lengthwise through the dosing tube 266 to facilitate precise control of an arc gap 304 between an arc tip 306 of the electrode assembly 294 and an arc tip 308 of an electrode assembly 310.

As illustrated, the electrode assembly 310 includes the electrode lead 268 extending through and sealed with the end cap 254 via the compliant seal 264, an arc electrode 312 coupled to the electrode lead 268, and the arc tip 308 coupled to the arc electrode 312. Advantageously, in certain embodiments, the electrode lead 268 also may be moved lengthwise through the plurality of concentric layers or sleeves 282, 284, 286, and 288 of the compliant seal 264 to facilitate further control of the arc gap 304 between the arc tips 306 and 308 of the electrode assemblies 294 and 310, respectively.

Upon reaching the desires arc gap 304, the electrode assemblies 294 and 310 may be secured in place via one or more sealing and securing techniques. For example, the illustrated electrode lead assembly 298 is secured within the dosing tube 266 via a mechanically compressed or crimped portion 314 and a laser welded portion 316 between the electrode lead assembly 298 and the dosing tube 266. Alternatively, the electrode lead assembly 298 may be coupled to the dosing tube 266 via a variety of other focused heating or sealing techniques, such as induction heating, or resistance welding, or arc welding, or laser welding, or combinations thereof. Similarly, a laser or another focused heating technique may be directed onto the compliant seals 262 and 264 to bond the dosing tube 266 and the electrode lead 268 to the end caps 252 and 254, respectively.

In certain embodiments, the lamp assembly 250 as illustrated in FIG. 8 is constructed by positioning the end caps 252 and 254 about the opposite ends 256 and 258 of the arc envelope 260, inserting the plurality of concentric layers or sleeves 270, 272, 274, and 276 of the compliant seal 262 within the cylindrical interior surface 278 of the end cap 252, inserting the dosing tube 266 within the innermost layer or sleeve 276, inserting the plurality of concentric layers or sleeves 282, 284, 286, and 288 of the compliant seal 264 within the cylindrical interior surface 290 of the end cap 254, inserting the electrode lead 268 within the innermost layer or sleeve 288, and then heating the entire assembly within a furnace.

Alternatively, a laser or another focused heating technique may be directed toward the joints between the various components. For example, a laser or another focused heating technique may be directed toward the interface between the arc envelope 260 and each of the end caps 252 and 254 to create a bond with or without a seal material. For example, if the arc envelope 260 has a ceramic material composition and the end caps 252 and 254 have a ceramic or cermet composition, then the end caps 252 and 254 and the arc envelope 260 may be coupled together via diffusion bonding without an intermediate seal glass material. Alternatively, a compliant seal having a plurality of adjacent layers or rings may be disposed between the arc envelope 260 and the end caps 252 and 254 if the end caps 252 and 254 have a material composition significantly different from the arc envelope 260. For example, the arc envelope 260 may have a ceramic material composition, while the end caps 252 and 254 may have a material composition including a metal (e.g., molybdenum, or rhenium, or tungsten, or a molybdenum-rhenium alloy, or a tungsten-rhenium alloy, or niobium, or combinations thereof), or a cermet (e.g., an alumina molybdenum cermet), or combinations thereof.

Similarly, a laser or another focused heating technique may be applied to the compliant seals 262 and 264. In certain embodiments, the dosing tube 266 has a material composition including molybdenum, or rhenium, or tungsten, or a molybdenum-rhenium alloy, or a tungsten-rhenium alloy, or niobium, or combinations thereof. Similarly, the electrode lead 268 may have a material composition including molybdenum, or rhenium, or tungsten, or a molybdenum-rhenium alloy, or a tungsten-rhenium alloy, or niobium, or combinations thereof. In contrast, the end caps 252 and 254 may have a different material composition than the dosing tube 266 and the electrode lead 268. For example, the end caps 252 and 254 may have a material composition, such as a transparent ceramic (e.g., same or different than arc envelope 260), a cermet (e.g., an alumina molybdenum cermet), or combinations thereof. In some embodiments, the end caps 252 and 254 may be formed from a metal or alloy different from the dosing tube 266 and the electrode lead 268. However, in such an embodiment, compliant seals may be disposed between the end caps 252 and 254 and the ceramic arc envelope 260. Thus, the plurality of concentric layers or sleeves 270, 272, 274, and 276 of the compliant seal 262 and the plurality of concentric layers or sleeves 282, 284, 286, and 288 of the compliant seal 264 generally have different material compositions, which provide a gradual or incremental change in properties or thermal expansion characteristics between the properties or thermal characteristics of the end caps 252 and 254 and the dosing tube 266 and electrode lead 268, respectively. The laser or other focused heating technique may be directed onto these compliant seals 262 and 264 to seal the various components together without undesirably heating the remainder of the lamp assembly 250.

A variety of material compositions are possible within the scope of the illustrated embodiment. For example, if the dosing tube 266 and the electrode lead 268 have a molybdenum-rhenium material composition and the end caps 252 and 254 have a ceramic material composition (e.g., alumina), then the layers or sleeves of the compliant seals 262 and 264 may include alumina molybdenum cermets. For example, the layers or sleeves 270/282, 272/284, 274/286, and 276/288 may material compositions including alumina and 8 percent by volume molybdenum, alumina and 22 percent by volume molybdenum, alumina and 36 percent by volume molybdenum, and alumina and 50 percent by volume molybdenum, respectively. In addition, as discussed with regard to the embodiments disclosed above, the arc electrodes 296 and 312 may have a material composition including tungsten or molybdenum, or rhenium, or combinations thereof. Similarly, the arc tips 306 and 308 may have a material composition including tungsten, or molybdenum, or rhenium, or combinations thereof. Finally, the electrode assembly 294 may be coupled and sealed to the dosing tube 266 after inserting a desired dosing substance within the lamp assembly 250. For example, a dose may be inserted through the dosing tube 266, and then the electrode lead assembly 298 may be inserted through the dosing tube 266 and secured and sealed via the compressed or crimped portion 314 and the laser welded portion 316. For example, the dose may include mercury, sodium, indium, thallium, scandium, halides of rare earth elements such as dysprosium, holmium, thulium, and inert gases such as krypton, argon or xenon, or combinations thereof.

FIG. 9 is a cross-sectional side view of an exemplary lamp assembly 320 having a dome shaped arc envelope 322, an end cap 324 coupled to the arc envelope 322, and compliant seals 326, 328, and 330 disposed about a dosing tube 332 and a pair of electrode leads 334 and 336 extending through the end cap 324. In the illustrated embodiment, the compliant seal 326 includes a plurality of concentric or radially adjacent layers or sleeves 338, 340, 342, and 344. Similarly, the compliant seal 328 includes a plurality of concentric or radially adjacent layers or sleeves 346, 348, 350, and 352, and the compliant seal 330 includes a plurality of concentric or radially adjacent layers or sleeves 354, 356, 358, and 360.

In certain embodiments, the arc envelope 322 has a ceramic material composition, the end cap 324 has a cermet or ceramic material composition (e.g., alumina), the dosing tube 332 has a molybdenum-rhenium alloy composition, and the electrode leads 334 and 336 have a molybdenum-rhenium alloy composition. In this particular embodiment, the compliant seals 326, 328, and 330 may include layers or sleeves having a material composition including alumina and 8 percent by volume molybdenum, alumina and 22 percent by volume molybdenum, alumina and 36 percent by volume molybdenum, and alumina and 50 percent by volume molybdenum in the order from the end cap 324 to the respective dosing tube 332 and electrode leads 334 and 336. However, the arc envelope 322, the end cap 324, the dosing tube 332, and the electrode leads 334 and 336 may have a variety of other material compositions as discussed in detail above.

In addition, the lamp assembly 320 includes arc electrodes 362 and 364 coupled to the electrode leads 334 and 336 within the cavity between the arc envelope 322 and the end cap 324. In the illustrated embodiment, the arc electrodes 362 and 364 are inwardly angled from the electrode leads 334 and 336 to set a desired arc gap 366 between arc tips 368 and 370 disposed on the arc electrodes 362 and 364, respectively. In addition, the arc electrodes 362 and 364 have a material composition including tungsten, or molybdenum, or rhenium, or combinations thereof. The arc tips 368 and 370 have a material composition including tungsten, or molybdenum, or rhenium, or combinations thereof.

The lamp assembly 320 may be constructed by positioning the end cap 324 against the arc envelope 322, inserting the dosing tube 332 and the compliant seal 326 through an opening in the end cap 324, inserting the electrode leads 334 and 336 and the respective compliant seals 328 and 330 through additional openings in the end cap 324, and heating the entire assembly within a furnace to bond the components to one another. Alternatively, a laser or another focused heating technique may be directed toward the specific interfaces between the various components to seal the components to one another. Subsequently, a dose may be inserted into the lamp assembly 320 via the dosing tube 332, which can be subsequently sealed via mechanical compression or crimped portion 372 and/or focused heating such as a laser weld 374. Again, the dose may include mercury, sodium, indium, thallium, scandium, halides of rare earth elements such as dysprosium, holmium, thulium, and inert gases such as krypton, argon or xenon, or combinations thereof.

FIG. 10 is a cross-sectional side view of an exemplary lamp assembly 380 having a semi-spherical or bulb-shaped arc envelope 382 and a compliant seal 384 disposed about a dosing tube 386 extending into the arc envelope 382. As illustrated, the compliant seal 384 includes a plurality of concentric layers or sleeves 388, 390, 392, 394, and 396 extending between a cylindrical interior surface 398 of the arc envelope 382 and a cylindrical exterior surface 400 of the dosing tube 386. The illustrated lamp assembly 380 also includes a pair of electrode assemblies 402 and 404 having leads 406 and 408 extending through the dosing tube 386 to arc tips 410 and 412, respectively. In addition, the lamp assembly 380 includes a pair of insulative inserts 414 and 416 (e.g., alumina or yttrium-aluminum-gamut, i.e., YAG) disposed within the dosing tube 386 and separating the leads 406 and 408, thereby setting a desired arc gap 418 between the arc tips 410 and 412.

In the illustrated embodiment, the arc envelope 382 has a ceramic material composition (e.g., alumina), whereas the dosing tube 386 has a nonceramic or different ceramic material composition. For example, the dosing tube 386 may have a material composition including tungsten, or molybdenum, or rhenium, or a molybdenum-rhenium alloy, or a tungsten-rhenium alloy, or combinations thereof. In one specific embodiment, the dosing tube 386 is formed of a molybdenum and 44 percent by volume rhenium alloy. Accordingly, the plurality of layers or sleeves 388, 390, 392, 394, and 396 of the compliant seal 384 include a variety of different materials having different properties or thermal expansion characteristics that gradually change from the arc envelope 382 to the dosing tube 386. For example, the layers or sleeves 388, 390, 392, 394, and 396 may have material compositions including alumina and 10 percent by volume molybdenum, alumina and 20 percent by volume molybdenum, alumina and 30 percent by volume molybdenum, alumina and 40 percent by volume molybdenum, and alumina and 50 percent by volume molybdenum in order from the arc envelope 382 (e.g., alumina) toward the dosing tube 386 (e.g., molybdenum-rhenium).

FIGS. 11, 12, 13, and 14 illustrate a lamp 420 at various stages of assembly in accordance with certain embodiments of the present technique. FIG. 11 is a partially exploded cross-sectional side view of an exemplary lamp 420 illustrating the assembly of compliant seals 422 and 424 with an arc envelope 426. As illustrated, the compliant seal 422 includes a plurality of concentric layers or sleeves 428, 430, 432, and 434, which are exploded from one another and an annular recess 436 disposed within a first end 438 of the arc envelope 426. Similarly, the compliant seal 424 includes a plurality of concentric layers or sleeves 440, 442, 444, and 446, which are disposed concentrically inside an annular recess 448 within a second end 450 of the arc envelope 426. In this exemplary embodiment, the annular recesses 436 and 448 facilitate the insertion and positioning of the plurality of concentric layers or sleeves of the compliant seals 422 and 424 within the arc envelope 426.

In addition, the illustrated lamp 420 includes corrosion protective covers 452 and 454 disposed against leading annular edges 456 and 458 of the annular recesses 436 and 448 within the arc envelope 426, respectively. The corrosion protective covers 452 and 454 have a substantially conical geometry and a material composition including tungsten, or molybdenum, or rhenium, or alumina, or yttrium-aluminum-garnet (YAG), or a molybdenum-rhenium alloy, or a tungsten-rhenium alloy, or combinations thereof. Alternatively, the corrosion protective covers 452 and 454 may have a flat or disk shaped geometry. In certain embodiments having corrosive dose materials disposed inside the lamp 420, the corrosion protective covers 452 and 454 provide additional protection against corrosion of the concentric layers or sleeves of the compliant seals 422 and 424.

As illustrated in FIGS. 11 and 12, the lamp 420 further includes dosing tubes 460 and 462 configured to be disposed within and sealed to the first and second ends 438 and 450 of the arc envelope 426 via the compliant seals 422 and 424, respectively. The lamp 420 also includes arc electrode assemblies 464 and 466 configured to be extended through and sealed with the dosing tubes 460 and 462, respectively. Similar to the embodiments of FIGS. 1 and 2, the arc electrode assemblies 464 and 466 include arc tips 468 and 470 coupled to arc electrodes 472 and 474, which are in turn coupled to electrode lead assemblies 476 and 478. The electrode lead assemblies 476 and 478 include wire overwraps 480 and 482 disposed about shanks or mandrels 484 and 486, respectively.

In the illustrated embodiment, the dosing tubes 460 and 462 are coupled to the arc envelope 426 via the compliant seals 422 and 424, followed by insertion and sealing of the arc electrode assemblies 464 and 466 within the dosing tubes 460 and 462. For example, the lamp 420 including the arc envelope 426, the compliant seals 422 and 424, the corrosion protective covers 452 and 454, and the dosing tubes 460 and 462 may be placed inside of a furnace, wherein the components are collectively heated and sealed to one another prior to sealing the arc electrode assemblies 464 and 466 and inserting a dose material within the lamp 420. In alternative embodiments, a laser or another focused heating technique may be applied to the layers or sleeves of the compliant seals 422 and 424 and the corrosion protective covers 452 and 454 to bond these components with the dosing tubes 460 and 462 and the arc envelope 426. Subsequently, the arc electrode assembly 466 may be inserted through the dosing tube 462 to the desired position of the upper tip 470, and then the dosing tube 462 is compressed or crimped and laser welded about the electrode lead assembly 478 at portions 488 and 490. However, the arc electrode assembly 464 may remain separated from the dosing tube 460 until a desired dose material can be inserted into the lamp 420, as illustrated with reference to FIG. 13.

FIG. 13 is a cross-sectional side view of the lamp as illustrated in FIGS. 11 and 12, wherein the dosing tube 460 is coupled to a processing system 500 in accordance with certain embodiments of the present technique. As illustrated, the processing system 500 is configured to connect with the dosing tube 460 at step or block 502, evacuate or remove material 504 from within the arc envelope 426 at step or block 506, input a dosing material 508 into the arc envelope 426 at step or block 510, insert the electrode lead assembly 476 through the dosing tube 460 at step or block 512, crimp the dosing tube 460 about the electrode lead assembly 476 at step or block 514, and then laser weld the dosing tube 460 to the electrode lead assembly 476 at step or block 516. In this manner, the dosing material 508 is not subjected to heat within a furnace, but rather the focused sealing techniques are applied between the dosing tube 460 and the electrode lead assembly 476. Again, the dosing material 508 may include mercury, sodium, indium, thallium, scandium, halides of rare earth elements such as dysprosium, holmium, thulium, and inert gases such as krypton, argon or xenon, or combinations thereof. Some of these dosing materials 508, such as metal halides, are particularly corrosive toward metals and other substances that may be used for the dosing tubes 460 and 462 and one or more of the layers or sleeve of the compliant seals 422 and 424. Accordingly, the corrosion protective covers 452 and 454 provide resistance against corrosion of these components during operation of the lamp 420.

FIG. 14 is a cross-sectional side view of the lamp 420 as illustrated in FIGS. 11, 12, and 13, wherein the dosing tube 460 is crimped and laser welded about the electrode lead assembly 476 at portions 518 and 520, respectively. Again, the electrode lead assemblies 476 and 478 may be disposed lengthwise through the dosing tubes 460 and 462 and secured in place upon reaching a desired arc gap 522 between the arc tips 468 and 470 of the arc electrode assemblies 464 and 466, respectively.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A lamp, comprising:

an arc envelope comprising a ceramic;

an end member comprising a material different from the ceramic; and a compliant seal disposed between the end member and the arc envelope, wherein the compliant seal comprises a plurality of layers having different thermal expansion characteristics in an order of gradual change between the arc envelope and the end member, and the plurality of layers comprises a plurality of alumina molybdenum cermet layers or a plurality of dysprosia-alumina-silica layers that vary in composition in the order of gradual change between the arc envelope and the end member.

2. The lamp of claim 1, wherein at least one layer of the plurality of layers of the compliant seal comprises spaces, slots, openings, grooves, channels, or a combination thereof.

3. The lamp of claim 1, wherein the different thermal expansion characteristics comprise different coefficients of elasticity from one layer to another.

4. The lamp of claim 1, wherein the plurality of layers of the compliant seal comprises a plurality of axial layers disposed axially between the end member and the arc envelope.

5. The lamp of claim 4, wherein the plurality of layers of the compliant seal comprises a plurality of concentric sleeves.

6. The lamp of claim 1, wherein the plurality of layers each comprise a constant thickness.

7. The lamp of claim 6, wherein the plurality of layers of the compliant seal comprises a plurality of concentric sleeves.

8. The lamp of claim 1, wherein the plurality of layers of the compliant seal comprises the plurality of alumina molybdenum cermet layers that vary in composition of alumina and molybdenum in the order of gradual change between the arc envelope and the end member.

9. The lamp of claim 8, wherein the alumina molybdenum cermet layers comprise a first layer having alumina and 8 percent by volume molybdenum, a second layer having alumina and 22 percent by volume molybdenum, a third layer having alumina and 36 percent by volume molybdenum, and a fourth layer having alumina and 50 percent by volume molybdenum.

10. The lamp of claim 8, wherein the alumina molybdenum cermet layers comprise a first layer having alumina and 20 percent by volume molybdenum, a second layer having alumina and 40 percent by volume molybdenum, a third layer having alumina and 60 percent by volume molybdenum, and a fourth layer having alumina and 80 percent by volume molybdenum.

11. The lamp of claim 8, wherein the arc envelope has a material composition including alumina, and the end member has a material composition including molybdenum and 44 percent by volume rhenium.

12. The lamp of claim 1, wherein the plurality of layers of the compliant seal comprises the plurality of dysprosia-alumina-silica layers that vary in composition in the order of gradual change between the arc envelope and the end member.

13. The lamp of claim 12, wherein the dysprosia-alumina-silica layers comprise a first layer having 74.5 wt % dysprosia-18.5 wt % alumina-7 wt % silica, a second layer having 72 wt % dysprosia-16 wt % alumina-12 wt % silica, a third layer having 69.5 wt % dysprosia-13.5 wt % alumina-17 wt % silica, and a fourth layer having 67 wt % dysprosia-11 wt % alumina-22 wt % silica.

14. The lamp of claim 1, wherein the different thermal expansion characteristics comprise gradually changing coefficients of thermal expansion within a range from $3\times10^{-6}$ Kelvin to $12\times10^{-6}$/Kelvin.

15. The lamp of claim 1, wherein the different thermal expansion characteristics comprise gradually changing coefficients of thermal expansion within a range from $5\times10^{-6}$/Kelvin to $9\times10^{-6}$/Kelvin.

16. A system, comprising:

a lamp, comprising:

an arc envelope comprising a first material composition including a ceramic;

a dosing tube comprising a second material composition including a cermet, or a metal, or a combination thereof;

an electrode lead extending through the dosing tube to an arc electrode disposed inside the arc envelope, wherein the dosing tube is compressed and sealed about the electrode lead; and a compliant seal disposed between the arc envelope and the dosing tube, wherein the compliant seal comprises a plurality of layers disposed one over another in a direction from the arc envelope to the dosing tube, the plurality of layers have different thermal expansion characteristics in an order of gradual change in the direction from the arc envelope to the dosing tube, and the plurality of layers vary in composition of ceramic and metal in the order of gradual change in the direction from the arc envelope to the dosing tube.

17. The lamp of claim 16, wherein at least one layer of the plurality of layers of the compliant seal comprises spaces, slots, openings, grooves, channels, or a combination thereof.

18. The lamp of claim 16, wherein the first material composition of the arc envelope comprises a first material, the second material composition of the dosing tube comprises a second material different from the first material, and the plurality of layers vary in composition of the first and second materials in the order of gradual change between the arc envelope and the dosing tube.

19. A lamp, comprising:

an arc envelope comprising a ceramic, wherein the arc envelope comprises a first axial surface;

an end member comprising a material different from the ceramic, wherein the end member comprises a second axial surface;

a compliant seal comprising a plurality of layers disposed one over another in an axial direction from the first axial surface of the arc envelope to the second axial surface of the end member, wherein the plurality of layers comprise different thermal expansion characteristics in an order of gradual change in the axial direction from the first axial surface of the arc envelope to the second axial surface of the end member, and the plurality of axial layers of the compliant seal comprises a plurality of cermet layers that vary in cermet composition in the order of gradual change in the axial direction between the arc envelope and the end member.

20. A lamp, comprising:

an arc envelope comprising a first material composition, wherein the first material composition comprises a first material;

an end member comprising a second material composition different from the first material composition, wherein the second material composition comprises a second material different from the first material; and a compliant seal disposed between the end member and the arc envelope, wherein the compliant seal comprises a plurality of layers disposed one over another in a direction from the arc envelope to the end member, the plurality of layers have different thermal expansion characteristics in an order of gradual change in the direction from the arc envelope to the end member, and the plurality of layers vary in composition of the first and second materials in the order of gradual change in the direction from the arc envelope to the end member.

21. The lamp of claim 20, wherein the first material of the arc envelope comprises a ceramic material, the second material of the end member comprises a metallic material, and the plurality of layers vary in composition of the ceramic and metallic materials in the order of gradual change in the direction from the arc envelope to the end member.

22. A lamp, comprising:

an arc envelope comprising a ceramic;

an end member comprising a material different from the ceramic;

a compliant seal disposed between the end member and the arc envelope, wherein the compliant seal comprises a plurality of layers disposed one over another in a first direction between the end member and the arc envelope, the plurality of layers have different thermal expansion characteristics in an order of gradual change in the first direction between the arc envelope and the end member, and edges of the plurality of layers are oriented in a second direction crosswise to the first direction; and a corrosion protective cover disposed between an interior volume of the arc envelope and the compliant seal, wherein the corrosion protective cover extends crosswise to the plurality of layers in the first direction across the edges in a manner isolating the plurality of layers from the interior volume.

23. A method, comprising:

positioning a compliant seal between an end member and a ceramic arc envelope, wherein the compliant seal comprises a plurality of layers disposed one over another in a direction from the ceramic arc envelope to the end member, a first material composition of the ceramic arc envelope comprises a first material, a second material composition of the end member comprises a second material different from the first material, the plurality of layers vary in composition of the first and second materials in an order of gradual change in the direction from the ceramic arc envelope to the end member, and the plurality of layers have different thermal expansion characteristics in the order of gradual change in the direction from the ceramic arc envelope to the end member; and simultaneously bonding the plurality of layers in place between the ceramic arc envelope and the end member.

* * * * *